US009718651B2

(12) United States Patent
Eriksson et al.

(10) Patent No.: US 9,718,651 B2
(45) Date of Patent: Aug. 1, 2017

(54) DETERMINING MOVEMENT DISTANCE OF LIFTING DEVICE

(71) Applicant: KONECRANES PLC, Hyvinkää (FI)

(72) Inventors: Lasse Eriksson, Espoo (FI); Mikko Heikkilä, Järvenpää (FI); Kari Wallgren, Hyvinkää (FI); Ari Lehtinen, Hyvinkää (FI); Olli Venho, Hyvinkää (FI); Lauri Nieminen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 369 days.

(21) Appl. No.: 14/403,332

(22) PCT Filed: May 23, 2013

(86) PCT No.: PCT/FI2013/050565

§ 371 (c)(1),
(2) Date: Nov. 24, 2014

(87) PCT Pub. No.: WO2013/175075

PCT Pub. Date: Nov. 28, 2013

(65) Prior Publication Data

US 2015/0142277 A1 May 21, 2015

(30) Foreign Application Priority Data

May 25, 2012 (FI) ..... 20125562

(51) Int. Cl.

| | |
|---|---|
| ***B66C 13/48*** | (2006.01) |
| ***B66C 15/04*** | (2006.01) |
| ***B66C 17/00*** | (2006.01) |

(52) U.S. Cl.
CPC ..... *B66C 13/48* (2013.01); *B66C 15/045* (2013.01); *B66C 17/00* (2013.01)

(58) Field of Classification Search
CPC ..... B66C 13/48; B66C 15/045; B66C 17/00
See application file for complete search history.

(56) References Cited

U.S. PATENT DOCUMENTS

| | | | |
|---|---|---|---|
| 6,256,553 | B1 | 7/2001 | Erikkilä |
| 2008/0053945 | A1 | 3/2008 | Schneider et al. |

(Continued)

FOREIGN PATENT DOCUMENTS

| | | | |
|---|---|---|---|
| CN | 101428741 | A | 5/2009 |
| EP | 2402280 | A1 | 1/2012 |

(Continued)

OTHER PUBLICATIONS

Konecranes, "SMARTON The Smarter Way to Lift," Konecranes Lifting Businesses Brochure, 2010, 16 pages.

*Primary Examiner* — Mussa A Shaawat
(74) *Attorney, Agent, or Firm* — Birch, Stewart, Kolasch & Birch, LLP

(57) ABSTRACT

A current operating mode of a lifting device is determined as the lifting device is moving a load in an operating area. An object in the operating area is positioned, in whose area the operation of the lifting device is restricted in comparison with the operating area around the object. A difference between the current operating mode of the lifting device and the restricted operating mode to be applied in the object is determined. On the basis of the difference, the distance travelled by the lifting device is determined when the current operating mode of the lifting device is changed to the operating mode to be applied in the restricted object.

24 Claims, 6 Drawing Sheets

(56) References Cited

U.S. PATENT DOCUMENTS

| | | | |
|---|---|---|---|
| 2008/0055103 | A1 | 3/2008 | Koide |
| 2010/0114373 | A1 | 5/2010 | Hale et al. |
| 2010/0243593 | A1 | 9/2010 | King et al. |
| 2011/0076130 | A1 | 3/2011 | Stocker et al. |
| 2013/0299440 | A1 | 11/2013 | Hermann et al. |

FOREIGN PATENT DOCUMENTS

| | | | |
|---|---|---|---|
| JP | 8-113319 | A | 5/1996 |
| JP | 2010-18364 | A | 1/2001 |
| JP | 2007-323112 | A | 12/2007 |
| JP | 2008-152380 | A | 7/2008 |
| WO | WO 2013/169941 | A1 | 11/2013 |

DETERMINING MOVEMENT DISTANCE OF LIFTING DEVICE

FIELD OF THE INVENTION

The invention relates to a lifting device and particularly to determining a movement distance of the lifting device.

BACKGROUND

Lifting devices, such as bridge cranes and harbour cranes are used to move loads of extremely heavy masses weighing often tens or hundreds or even thousands of tons, for example. Because of the size of the masses to be moved, lifting devices must be operated according to strict safety regulations. The aim of safety regulations is to protect both the environment of the lifting devices, such as people and structures, and the lifting device itself.

The operating environment of the lifting device may be a warehouse, for example, in which the lifting device knows how to fetch loads and convey them between specified locations in the warehouse. The routes for the lifting device in question may be determined in advance, safety risks involved in the use of the lifting device thus being restricted to the routes it uses in the warehouse. The routes of the lifting device may be marked on the warehouse floor, for example, to allow the staff moving in the warehouse to keep away from the route and thus at a distance required by the safety regulations from the lifting device or its load. Since a specific space is reserved for moving the lifting device, other traffic in the warehouse requires a separate space reserved for it, the space being thus not available for storage of goods, which impairs the efficiency of surface space use in the warehouse. Since the route of the lifting device and/or the space reserved for it is often defined on the basis of the maximum amount of transferable load, the space to be reserved for the lifting device operation may be quite large in proportion to the size of the warehouse.

Nevertheless, a lifting device may generally be driven, contrary to the above policy, outside the marked route either accidentally or intentionally, and thus dangerous situations may arise despite the large space reserved for the operation of the lifting device.

When a lifting device is taken in use, a safety distance to fixed constructions of the warehouse, such as the walls and/or pillars, may be determined either fixedly or on the basis of a load weight measurement to provide a limit beyond which the lifting device cannot be driven. When the lifting device has been taken in use, the distance to the fixed constructions may be measured by a positioning system of the lifting device, the system being often based on laser measurement devices and/or on absolute or increment coders, which allow the movement of the load to be stopped at the safety distance from fixed obstacles. However, safety distances to fixed constructions do not take into account changes taking place in the warehouse that affect the movement of the lifting device. These may include other traffic in the warehouse, such as machines or people, and changes taking place in the warehouse, such as new walls or removal of walls.

Since the lifting device is unable to move within the determined safety distances after the device has been taken in use, the safety distances contribute to restricting the efficient use of the warehouse premises. Too large safety distances diminish the efficiency of use of the warehouse premises, whereas too narrow safety distances are not allowed due to security considerations.

In a situation in which the warehouse has been renovated by removing walls, for example, areas with no determined safety zones and/or routes have become part of the operating environment of the lifting device. In that case it is not possible to drive the lifting device safely in the renovated warehouse without re-introduction into use of the lifting device to determine the safety distances and/or routes. Introduction into use always requires that an expert of the lifting device supplier or serviceman is called to the site, which naturally causes costs to the owner and/or user of the lifting device.

New specifications for the lifting device may require a person specifically trained for the task, which may prevent the lifting device from being used until such a person has arrived. In other words, before new specifications are defined, the lifting device cannot be used for its ordinary tasks. However, in terms of economy, the downtime of an expensive apparatus like a lifting device should be kept as rare and short as possible. It is therefore desirable that downtime in the operation of the lifting device is as short as possible.

Moreover, a typical dangerous situation in crane use is caused by people and other machines, such as forklifts and trucks, moving in the vicinity of the load to be transferred. The crane operator does not necessarily always see people and/or machines coming in front of the machine behind a load. In addition, it is not possible to stop the load in an instant, and a sudden braking would swing a moving load to the direction of movement of the crane, possibly causing the crane to hit the object that has come in front of it. The swinging may be prevented by controlled braking, using the swing prevention mode of the crane. However, a controlled braking requires that the braking begins sufficiently early before the load is close to the object.

BRIEF DESCRIPTION OF THE INVENTION

The following is a simplified summary of the invention to provide a basic understanding of some aspects of the invention. This summary is not an extensive description of the invention and is not intended to identify the important/critical elements of the invention or to define the scope of the invention. Its only intention is to present some concepts of the invention in a simplified form as an introduction to a more detailed description that follows.

It is an object of the present invention to provide a solution to alleviate the above-mentioned drawbacks. The object of the invention is achieved by devices, methods and a computer program product that are characterised by what is stated in the attached independent claims. Preferred embodiments of the invention are disclosed in the dependent claims.

The idea of the invention is that it allows changes in the operating environment of the lifting device to be detected and the operation of the lifting device to be altered on the basis of the detected changes. The detected changes may be stored in a model of the operating environment provided in the lifting device to allow the changes to be taken into account in route planning. In addition, detected objects may be identified to allow the operation of the lifting device to be determined according to the type of the objects.

According to an aspect of the invention, a method is provided, comprising: determining a current operating mode of the lifting device as the lifting device moves a load in an operating area; positioning in the operating area an object in the area of which the operation of the lifting device is restricted in comparison with the operating area around the object; determining a difference between the current operating mode of the lifting device and the restricted operating mode to be applied in the object; determining on the basis of the difference a movement distance travelled by the lifting device when the current operating mode of the lifting device is changed to the operating mode to be applied in the restricted object.

According to another aspect of the invention, a device is provided comprising means arranged to perform a method according to an aspect.

According to another aspect of the invention, a computer program product is provided comprising program instructions that make a device execute a method according to an aspect after being downloaded into the device.

According to another aspect of the invention, a lifting device is provided comprising a device according to an aspect.

According to another aspect of the invention, there is provided a bridge crane, gantry crane, harbour crane (container crane, container straddle carrier, etc.) or a tower crane comprising a device according to an aspect.

According to an aspect of the invention, there a method is provided for updating a lifting device, the lifting device comprising lifting means for moving a load and a controller controlling the lifting means, and a communication path connecting the lifting devices and the controller, a device according to any aspect being connected to the communication path.

Some aspects of the invention allow the operation of the lifting device to be adjusted to a changing operating environment.

Some aspects of the invention allow the operation of the lifting device to be adjusted according to the types of objects detected in the operating environment.

Some aspects of the invention allow the lifting device to be driven according to the relative positions of the lifting device and the operator. This control method facilitates and enhances the driving of the lifting device and makes the driving safer, because the operator does not need to look at the controller, for example, when driving the lifting device.

Some aspects of the invention allow the operator of the lifting device to move more safely and freely than before when driving lifting device.

Some aspects of the invention allow the operating environment of the lifting device to be learned without detailed position data on the objects in the operating environment entered by the operator.

Some aspects of the invention allow a lifting device that has already been taken into use to be updated to perform an operation according to an aspect. The aspects of the invention can thus be implemented both in new cranes and in those already in use.

Some aspects of the invention allow the safety of use of the lifting device to be improved by measuring changes in the operating environment of the crane and the state of the crane and by changing, when necessary, the operating mode of the crane.

Other advantages of the invention are set forth in the attached description.

BRIEF DESCRIPTION OF THE FIGURES

The invention is now described in closer detail in connection with preferred embodiments and with reference to the accompanying drawings, in which.

DETAILED DESCRIPTION OF THE INVENTION

The embodiments discussed in the following disclosure present examples of the embodiments of the invention. Although reference to an or one embodiment or some embodiments may be made in several points of the disclosure, this does not necessarily mean that in each case reference is made to the same embodiment or embodiments, or that the feature is only applicable in one embodiment. In other words, individual features of different embodiments may be combined to provide other embodiments.

Figure 1A:
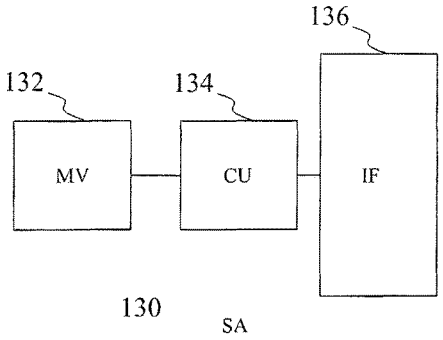
FIGS. 1*a* and 1*b* show devices for implementing the disclosed embodiments.
Figure 1B:
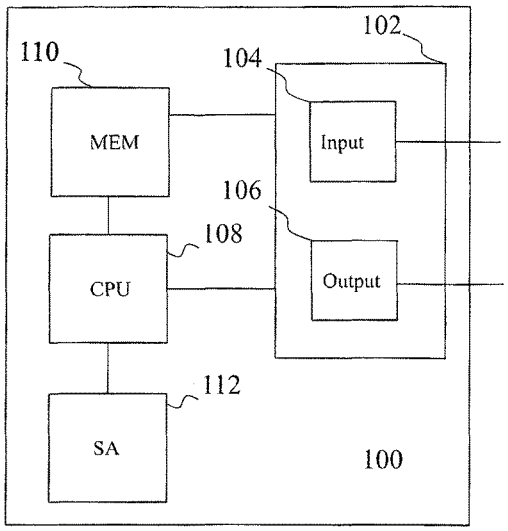

FIGS. 1*a* and 1*b* show devices 130 and 100 that may be used to implement the disclosed embodiments. It is to be noted that the parts of devices shown in FIGS. 1*a* and 1*b* are logical parts of the devices and may be implemented as one or more physical units.

FIG. 1*a* shows a device according to an embodiment. The device comprises positioning means 132, such as a machine vision (MV) system 132 for observing an operating environment, a calculating unit (CU) 134 and an interface (IF) 136. The device may be connected to the lifting device through the interface, which allows for a safe operation of the lifting device also in a changing operating environment. In the following disclosure the device is referred to as a security assistant.

The calculating unit receives observations of the operating environment from the positioning means. The observations may be points or areas in a selected coordinate system. The coordinate system may be a Cartesian, polar, cylindrical, spherical and map coordinate system, WGS84 used in the GPS (Global Positioning System) being an example of the one mentioned last. On the basis of the observations received from the positioning means, the calculating unit may calculate positions and speeds of the lifting device, its parts and/or detected objects. The calculated values may be transferred from the security assistant through the interface 136 to the lifting device that may use the data it receives for controlling the lifting device. Table 1 shows examples of the data produced by the calculating unit that may be transferred to the lifting device through the interface 136.

TABLE 1

Examples of observation data of the security assistant.

| Observation | Description | Measured in proportion to | Unit | Form | Example |
|---|---|---|---|---|---|
| 3D location of hook | Location of midpoint on top surface of hook block | Coordinates of calculating unit or trolley | cm | Directions: x, y, z (trolley, bridge, height) | 15, 17, 1087 |
| 3D speed of hook | Hook speed | Coordinates of calculating unit or trolley | cm/s | Directions: x, y, z (trolley, bridge, height) | 20, 0.5, −6.5 |
| 2D location of lifting device | Travel path of trolley in movement directions of bridge and trolley | Coordinates of operating area | cm | Trolley, bridge | 184, 1784 |
| 2D speed of lifting device | 2D speed of trolley | Coordinates of operating area | m/min | Trolley, bridge | 0.6, 0.2 |
| 3D dimensions and position of load | Load size and position (length, width, height) | Measured in movement directions of bridge, trolley and lifting movement in relation to trolley. Height may also be measured in relation to floor. | cm | Length in positive and negative movement directions of bridge and width in those of trolley (load dimension is measured from origin to all four directions to also obtain position of load in relation to trolley), height from trolley/floor to bottom of load and top surface. | 56, −22, 128, −152, 200, 900 |
| Loading space | On/Off | | | On = loaded, Off = not loaded | 1 |
| Sway angle of 2D load | Load sway angle in movement direction of lifting device transfer | Trolley coordinates | rad | Angle in trolley direction, angle in bridge direction | 0.05, −0.02 |
| Sway area of 2D load | Size of sway area, i.e. area in which load moved during the past 5 sec., for example, in lifting device transfer directions. | Trolley coordinates | cm | Length and width in positive and negative movement directions of trolley and bridge | 75, −22, 174, −27 |
| Detecting object | Coordinates, height and speed of square area that just fits the object | Position on coordinate axes of trolley, height and speed on coordinate axes of operating area | cm, cm/s | Opposite corner points, height and 2D speed of square area ($x_{11}$, $y_{11}$, $x_{12}$, $y_{12}$, $z_1$, $v_x$, $v_y$) | 530, 740, 630, 640, 200, 10, −20 |

The calculating unit may be provided with memory, either integrated or as a separate memory (not disclosed). The memory may be a volatile memory or non-volatile memory, such as EEPROM, ROM, PROM, RAM, DRAM, SRAM, programmable logic, etc. The memory may be used for storing data presented in the disclosed embodiments, for example, such as data on an operating mode and an operating environment of the lifting device.

According to an embodiment, the device 130 is installed in connection with the lifting device, the operating environment to be observed comprising the operating environment of the lifting device, such as a warehouse building, for example a hall in a warehouse, or a harbour area or a similar operating area. The operating environment to be observed in the lifting device preferably comprises a load, in which case the location and/or dimensions of the load may be detected.

The positioning means locate positions of objects in the operating environment. The objects may be stationary or they may move. The objects may thus be of different types. Examples of objects include people, containers, loads moved by the lifting device, pillars, walls, etc. The positioning means produce information on the position of one or more objects. This allows information on the positions of the detected objects to be obtained for use in distance calculations. Information on the position of an object may be produced using a selected coordinate system, such as the Cartesian coordinate system. Other coordinate systems may also be used. The coordinate system may be two-dimensional (2D) or three-dimensional (3D). The selected coordinate system may be fixed to the lifting device in connection with which the device 130 and the positioning means operate, the positioning data produced by the positioning means thus being relative to the fixing point of the coordinates.

Examples of positioning means comprise cameras, particularly stereo and depth cameras (e.g. time of flight, ToF, cameras) and rotating stereo cameras, laser scanners (2D and 3D), systems based on ultrasound, radars, satellite positioning systems (e.g. Global Positioning System (GPS)) and radio positioning systems. As technology advances, also positioning devices improve and their number increases, and thus a skilled professional may use positioning means available in each particular case to produce the advantages and benefits of the disclosed embodiments.

When one or more cameras are used, objects and their position in relation to the camera are detected from the image data received from the cameras.

When a radio positioning system is used, a radio frequency signal is received from one or more radio transmitters in an object. The radio frequency signal may contain the position data of the object, or the radio transmitter may be positioned by means of triangulation, for example.

According to an embodiment, the positioning means or a part thereof may be attached to a crane, e.g. to a crane trolley, crane bridge, crane hook block or an operating environment of the crane, e.g. to walls, ceiling, shelves, etc. in the operating area of the crane. In that case the device 130 may position dimensions of the loads moved by the lifting device and the dimensions of the load may be taken into account in distance calculations.

Positioning based on radio frequency may be implemented by a wireless local area network technology WLAN, Bluetooth, UWB (Ultra Wide Band technology) based on IEEE 802.11, or a combination of these. The position of the object may be calculated by triangulation on the basis of received signal strength (RSSI) from radio frequency signals received from a radio transmitter placed in the object and/or from a propagation time and reception direction angle of the radio signal.

According to an embodiment, the device 130 is used in the lifting device for positioning objects in the operating environment of the lifting device and/or the lifting device load. In the positioning, the positions of the objects may be determined in a coordinate system fixed to the lifting device. On the basis of the position data produced by the positioning means the calculating unit then calculates the position of the load in relation to a fixing point of the coordinates, which point may be a part of the lifting device, such as a trolley or hook of a bridge crane.

According to an embodiment, the positioning means produce information on the dimensions and/or position of the load in a selected coordinate system by means of cameras or a laser-based system, for example. The position of the load may be calculated utilizing the position data obtained from the lifting device, such as the position of a bridge and/or a crane and a rope length.

In a lifting device in which the load is moved by lifting it by a rope or a cable, swaying of the load may appear. As the load sways, a sway angle in relation to the lifting direction is formed. Because of the sway angle, the load may be on the skew in relation to the position of the trolley and, therefore, a positioning system (machine vision, laser) or rope angle measurement by an acceleration or tilt angle sensor may be additionally used to determine the precise position of the load.

FIG. 1*b* shows a device 100 that illustrates the functionality of a device according to an embodiment of the invention. The device 100 of FIG. 1 *b* comprises a central processing unit (CPU) 108, memory (MEM) 110, an interface 102 and a security assistant (SA) 112. The security assistant may comprise the device of FIG. 1*a* which positions objects in the operating environment of the device 100 and thus increases the safety of use of the device 100. The device 100 may be e.g. a lifting device, such as a crane, bridge crane, gantry crane, tower crane or a harbour crane, such as a container crane, continer straddle carrier, rubber tyre gantry crane or a gantry crane moving on rails.

The processing unit 108 may comprise a set of registers, an arithmetic-logical unit and a control unit, such as a programmable logic controller (PLC). The control unit is controlled by a sequence of program instructions that are transferred to the processing unit from the memory. The control unit may contain numerous microinstructions for basic functions. Implementation of the microinstructions may vary depending on the configuration of the processor unit. The program instructions may be encoded in a programming language, which may be a high-level programming language, such as C, Java, etc., or a low-level programming language, such as the PLC device's own language, a machine language or an assembler. The memory may consist of several types and be a volatile memory or non-volatile memory, such as EEPROM, ROM, PROM, RAM, DRAM, SRAM, programmable logic, etc.

The interface 102 provides an interface through which the user of the device, the operator, may communicate with the device. The interface may comprise an output unit 106 for transmitting data to the operator and an input unit 104 for transmitting data from the operator to the device. The functionalities of the interface may be implemented by a touch screen, for example, in which the data are shown to the operator as a visual signal and data are input by the touch of the operator. The touch screen may be connected to the device 100 by a wire or the connection may be wireless. A wireless connection provides the operator with more freedom of movement than a wired connection.

According to an embodiment, the interface 102 is implemented by a data processing device with a touch screen, such as a panel computer. Examples of applicable panel computers include Apple IPad and Samsung Galaxy Tab. To allow for data transfer between the operator and the lifting device, the device may have an application installed therein, and when the application is being executed, the panel computer shows the user interface of the lifting device. As the operator touches the interface shown on the panel computer, a command is received that may be transmitted to the lifting device over a wireless connection. The wireless connection may be implemented by WLAN, for example, or a similar wireless technology.

An embodiment provides a computer program on a distribution medium and comprising program instructions that when downloaded into an electronic device make the processing unit execute an embodiment according to the present invention.

The computer program may be in source code format, object code format or in some intermediate format, and it may be stored on a transfer medium that may be any entity or device that is capable of storing the program. Transfer media of this type include a storage medium, computer memory, read-only memory, electric carrier wave, data communications signal and software distribution package, for instance.

The device parts shown in FIGS. 1*a* and 1*b* are all electrically connected to one another. The connections between the parts may be implemented by a communication bus providing two-directional communication between the parts of the device. Examples of such I/O buses (input/output buses) include Ethernet, ISA (Industry Standard Architecture), ProfiBus (Process Field Bus) and CANopen. The connections between the parts of the devices may be implemented in different ways depending on the level of integration between the parts, which allows different buses to be used for connections between the different parts. When memory and CPU, for example, are integrated on the same circuit board, communication between them may use a data transfer bus of the circuit board. In that case the connection of the memory and the CPU to other parts of the device 100 may be implemented by Ethernet and for this purpose the circuit may further comprise circuits implementing the Ethernet connection.

The devices 100 and 130 may also be implemented by one or more integrated circuits, such as an ASIC circuit (Application Specific Integrated Circuit). Other implementations are also possible, such as a circuit made of separate logic components. A hybrid of these different implementation alternatives is also possible. An example of circuits made of logic components is the FPGA (Field Programmable Gate Array) circuit.

It is apparent to a person skilled in the art that the devices shown in FIGS. 1*a* and 1*b* may also contain other parts than those described above, but which are not essential to the invention and have, therefore, been left out to make the presentation clearer.

According to an embodiment, a lifting device in operation may be updated by the security assistant to implement the functionality of the disclosed embodiments. This allows the advantages of the disclosed embodiments to be achieved also in lifting devices already in use. For example, the security assistant of FIG. 1*a* may be installed to a lifting device comprising lifting means for moving a load and a controller controlling the lifting means and a communication bus connecting the lifting means and the controller. In that case the security assistant may be connected to the communication bus of the lifting device.

The functionality of the disclosed embodiments may be implemented in various ways by a lifting device and a security assistant installed in connection with it. Tasks may be divided between the lifting device and the security assistant in various ways, depending e.g. on the characteristics of the security assistant and the lifting device, such as their performance or software versions. According to an embodiment, the functionality of the security assistant comprises object positioning and transmitting data on the detected objects to the lifting device. Other functionalities, such as control of the lifting device on the basis of the detection data, may thus be carried out in the lifting device. Since the security assistant is not required to control the lifting device nor receive operating mode data of the lifting device, the implementation of the security assistant may be kept simple. Typically a PLC-controlled lifting device, for example, with security assistant connected thereto, has sufficient resources for implementing in the lifting device the control as required by the disclosed embodiments. In other words, functionalities according to the disclosed embodiments may be implemented by the PLC of the lifting device, and thus the security assistant does not need to control the lifting device but the PLC works according to the information received from the security assistant. Examples of the content of such communication between the security assistant and the lifting device are shown in table 2.

TABLE 2

Example of a message from a security assistant to a PLC-controlled bridge crane.

| Data | Example |
|---|---|
| Sensor ID | 1-999 |
| Observation ID | 1 = Hook loading state<br>2 = Load sway area<br>3 = Object observation (see object type) |

TABLE 2-continued

Example of a message from a security assistant to a PLC-controlled bridge crane.

| Data | Example |
|---|---|
| | 4 = Raising or lowering of hook<br>5 = Bridge movement<br>6 = Trolley movement<br>7 = Load dimensions<br>8 = Lifting device stationary<br>9 = Hook sway (when carrying load)<br>10 = Load sway amplitude<br>21 = Load path in 3D coordinate system<br>30 = Malfunction |
| Time stamp | hh:mm:ss:ms |
| Date | dd.mm.yyyy |
| Object ID | 1 - 1 000 000 |
| Object corner point x1 | Unit of measurement: cm |
| Object corner point y1 | Unit of measurement: cm |
| Object corner point x2 | Unit of measurement: cm |
| Object corner point y2 | Unit of measurement: cm |
| Object height from floor z | Unit of measurement: cm |
| Reliability of observation | Percentage % |
| Object type | 1 = Hook<br>2 = Bridge<br>3 = Trolley<br>4 = Human being<br>5 = Moving object (truck, forklift . . .)<br>6 = Stationary object (office, desk, shelf, wall, beam, . . .)<br>7 = Load<br>99 = Unidentified |
| Speed in direction X | −999 to 999 (cm/s) |
| Speed in direction y | −999 to 999 (cm/s) |
| Speed in direction Z | −999 to 999 (cm/s) |

According to an embodiment, the functionality of the security assistant comprises positioning objects and transmitting data on the detected objects to the lifting device, and also controlling the lifting device. The disclosed embodiments may be difficult to implement in lifting devices already in use due to incompatibility of software and/or connections. The lifting devices in question typically do not have PLC. In that case the functionalities of the disclosed embodiments are preferably implemented in the security assistant, i.e. the security assistant operates independently. In other words, the functionalities of the disclosed embodiments may be carried out in the security assistant that is connected to the lifting device over the interface. On the basis of the operating mode data received through the interface and the observation data formed in the security assistant, the security assistant may control and/or restrict the operation of the lifting device, e.g. move the bridge, trolley and/or hook of a bridge crane, or prevent or slow down a movement in a direction. Examples of operating mode data are disclosed in table 4 below. Examples of the content of such communication between the lifting device and the security assistant are shown in table 3.

TABLE 3

Example of a message from an independent security assistant to a bridge crane.

| Data | Example |
|---|---|
| B1 dir | Bridge direction 1 (allow/prevent/stop) |
| B2 dir | Bridge direction 2 (allow/prevent/stop) |
| T1 dir | Trolley direction 1 (allow/prevent/stop) |
| T2 dir | Trolley direction 2 (allow/prevent/stop) |
| H1 dir | Hook direction (lifting) 1 (allow/prevent/stop) |
| H2 dir | Hook direction (lifting) 2 (allow/prevent/stop) |

Figure 2A:
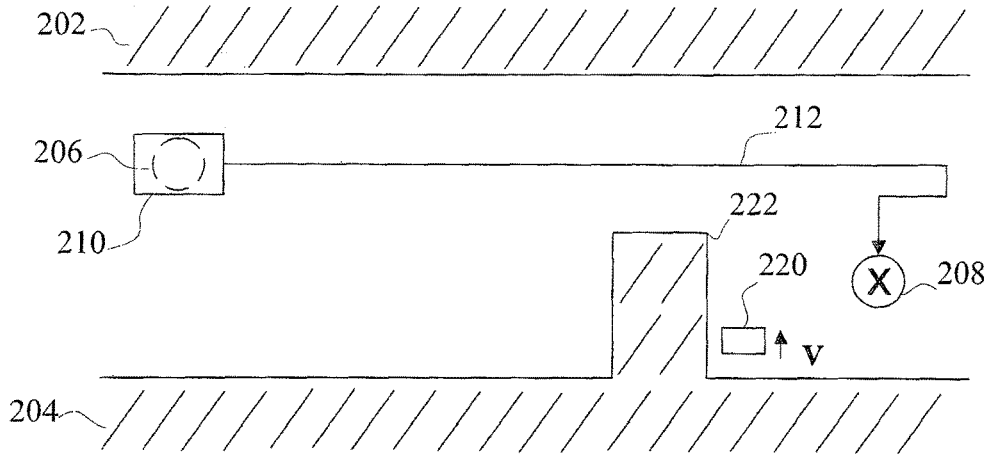
FIGS. 2*a*, 2*b* and 2*c* show situations according to some embodiments when a load is being moved by a lifting device within the operating area of the device.
Figure 2B:
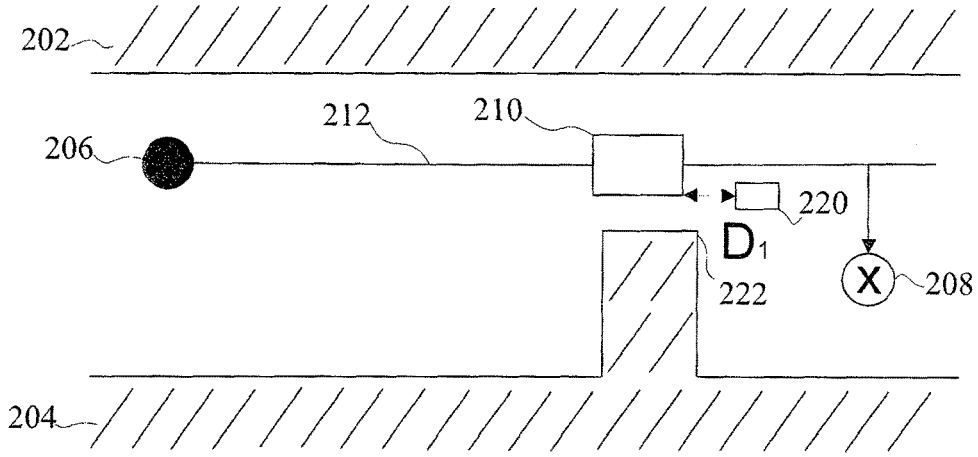
Figure 2C:
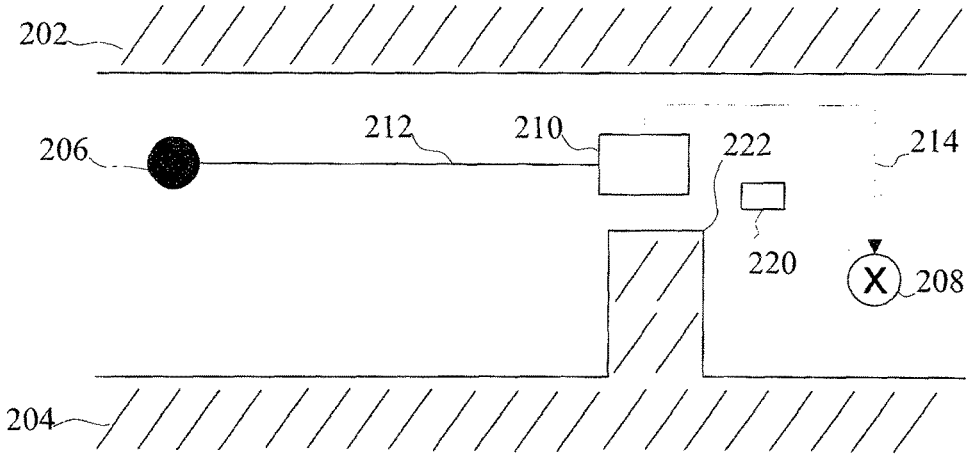

FIGS. 2*a*, 2*b* and 2*c* show situations according to some embodiments when a load is being moved by a lifting device in its operating area. FIGS. 2*a*, 2*b* and 2*c* show a cross-section of an operating environment of the lifting device seen from above. The figure depicts situations in which the lifting device operates on the basis of data produced by the security assistant installed in the device. The situations of FIGS. 2*a*, 2*b* and 2*c* depict operation when the security assistant uses cameras to locate objects in the operating environment of the lifting device. It is to be noted that the situations shown in FIGS. 2*a*, 2*b* and 2*c* may just as well be applicable when observation and positioning based on other than cameras or a combination of different observation and positioning systems is used in the security assistant. In that case the observation of objects in the operating environment of the lifting device may be based e.g. on receiving radio frequency signals from the object or on both receiving radio frequency signals from the object and camera positioning or, alternatively, on laser scanners and a combination of it and those already mentioned.

The operating environment may be e.g. a warehouse building, a hall in a warehouse or a harbour area or a similar operating area. In FIGS. 2*a*, 2*b* and 2*c*, the lifting device has a load 210 provided with a planned route 212 between a starting point 206 and a destination 208. The route 212 may be stored in the memory of the lifting device or the operator may keep it in his/her head when driving the lifting device between the starting point 206 and the destination 208. The operating environment may be restricted with respect to areas 202 and 204 which the lifting device is not allowed to access for moving or fetching a load. The areas 202 and 204 may be walls or areas reserved for other operations, for example.

FIG. 2*a* shows an initial situation with the load in its starting point 206 from where its transfer to the destination 208 begins. Here the object 220 in the operating environment is not detectable by the lifting device, because the object is behind a corner 222 and thus not visible in the picture conveyed by the camera in the security assistant of the lifting device. In this example the object 220 is a human being moving from the side of a wall 204 to another wall 202. Consequently, the routes of the human being 220 and the load 210 carried by the lifting device intersect. In FIG. 2*a*, the movement of the human being is illustrated by a speed vector v.

FIG. 2*b* shows a situation after the starting point of FIG. 2*a*, the lifting device having now carried the load 210 on the route 212 to a location where the security assistant detects the position of the human being 220. The security assistant may also determine the shortest distance $D_1$ to the human being 220. The distance may be determined in the lifting device on the basis of position data produced by the security assistant. The security assistant preferably determines the shortest distance $D_1$ between the load and a restricted object in order to allow the crane to stop before the load and the object collide. The shortest distance may be determined as a distance from the outermost edge of the load in the direction of the object to an edge of the object closest to the load.

In addition to distance determining, the lifting device provided with the security assistant may determine a direction of the human being 220 in relation to the lifting device or a part thereof, as in the example of FIG. 1, where, in field "Object identification", the object is positioned in a coordinate system the origin of which is in the lifting device trolley, and the position of the object is expressed in directions x and y in relation to the trolley. In addition to the position of the human being 220, the lifting device provided with the security assistant may determine a speed and a direction v of the speed for the human being 220.

FIG. 2*c* shows a situation after the one in FIG. 2*b*, where the lifting device has detected the human being 220 and determined the position of the human being in relation to the lifting device. On the basis of the position and/or speed data of the object obtained by the security assistant of FIG. 2*b*, the route has been changed so that after the situation in FIG. 2*b* the route follows a new path 214 to the destination 208. In the situation of FIG. 2*c* a new route is thus determined for the load 210 moved by the lifting device on the basis of the object detected in the operating environment. For re-determining the route, observation of the load size is also preferably needed in order to estimate whether the load hits the detected object or not. On the basis of the estimation it is possible to decide on a need for re-planning of the route and, if necessary, to re-plan the route. If a collision is detected as possible, a new route is calculated using the data indicating that the load on board is of a specific size (for calculating where it can travel without a risk of collision).

It is to be noted that the distance, direction and relative speed detected between the lifting device and the human being in the situation of FIG. 2*b* could also have been used for selecting other actions than determining a new route 214 as disclosed in FIG. 2*c*. The high safety requirements regulating the operation of lifting devices may prescribe that no people are allowed under a load moved by a lifting device. In other words, if the object shown in FIGS. 2*a*, 2*b* and 2*c* were a container and not a human being, it would be possible to determine a new route also in the height direction, meaning that the load would be lifted above the container. In that case the change in route would not be visible in FIG. 2*c*, which is a top view of the operating environment of the lifting device.

It is therefore to be noted that the operation of the lifting device may be adjusted in the operating environment of FIGS. 2*a*, 2*b* and 2*c* also in other ways that comprise one or more of the following, for example: stopping the lifting device, raising the load, lowering the load, increasing speed, decreasing speed. Adjustment of the lifting device operation allows safety requirements to be met for each object when a load is moved by the lifting device.

Figure 3:
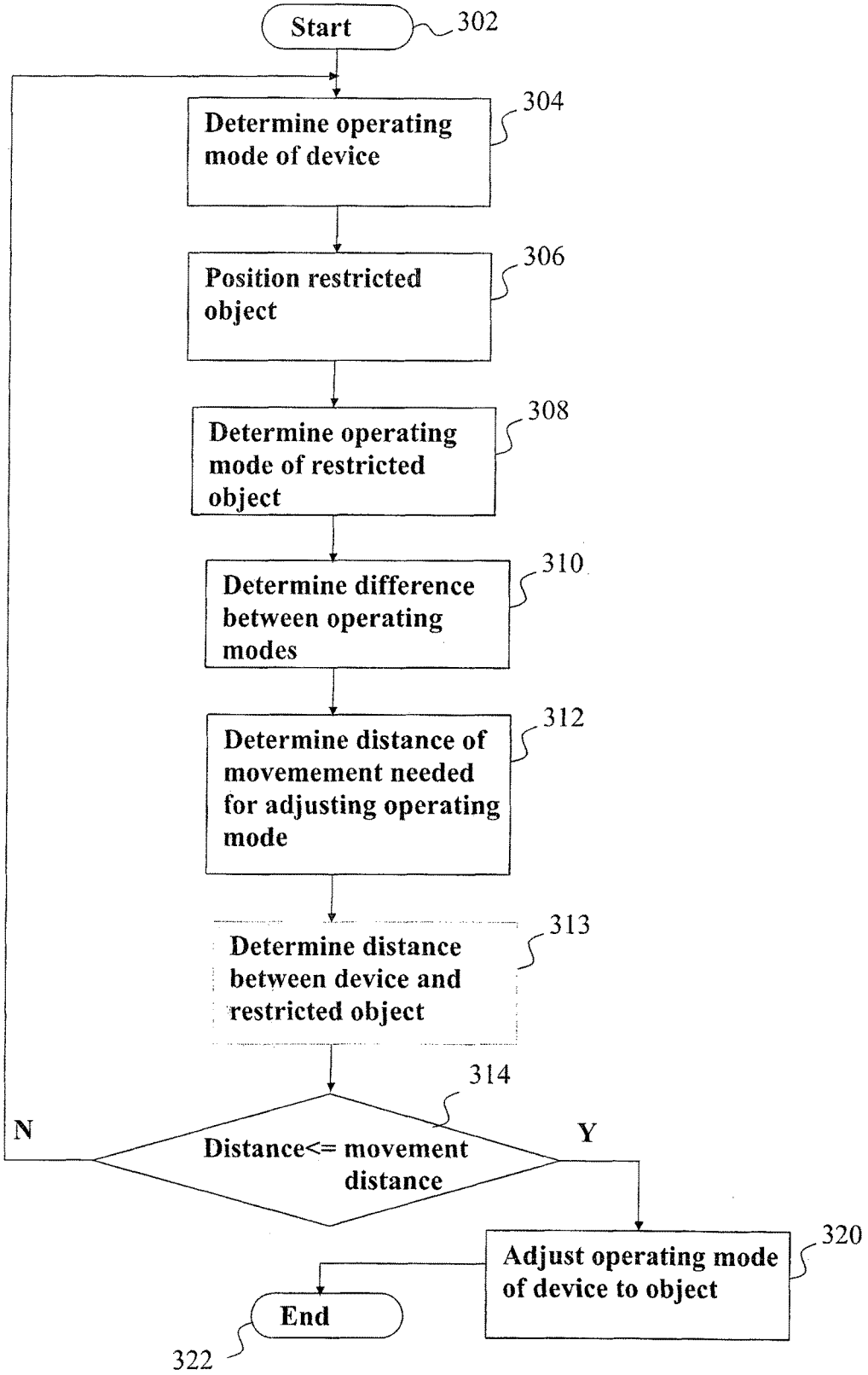
FIG. 3 shows a method according to an embodiment.

FIG. 3 shows a method according to an embodiment. The method of FIG. 3 may be implemented by a lifting device of FIG. 1*b*, for example, provided with a security assistant. The method starts 302 when the lifting device is used in its operating environment. In this method the operating environment may be an operating area as disclosed in the above examples. When the lifting device is being driven, it moves a load attached to the lifting device by a gripping means. The gripping means, such as a hook, may be lowered or lifted by ropes fastened thereto.

The current operating mode of the lifting device is determined 304 as the lifting device moves the load in the operating area. The operating mode may comprise position data, speed data traffic prohibition, driving instruction, speed limit, outer dimensions of the load, load weight and loading data. The data of the operating mode may relate to different parts of the lifting device. The position data may be presented using a suitable coordinate system. Examples of coordinate systems comprise Cartesian, polar, cylindrical, spherical and map coordinate systems, WGS84 used in the GPS (Global Positioning System) being an example of the last one. The position data relating to the different parts of the lifting device or the load may be shown also in different coordinates. The data needed for determining an operating mode of the lifting device are available from the control system of the lifting device or, when necessary, from measurement devices to be connected separately to the lifting device, and since the operation of the devices is clear to a skilled professional, it is not discussed further in this context.

When the lifting device is a bridge crane that grabs loads to be moved by a hook or another gripping means suspended on one or more ropes, the position data preferably comprises the position of the bridge, trolley and hook of the bridge crane in the coordinates of the operating environment. Table 4 below shows an example of an operating mode of a bridge crane, the different parts of the bridge crane, its trolley, bridge and hook being provided with separate operating modes.

According to an embodiment, when part of the movement direction of the lifting device deviates from the direction of the selected coordinate axis and/or the lifting device part moves in relation to several coordinate axes, the direction of the part in question may be given in degrees, as shown in table 4, for the hook sway angle.

The position data may comprise the position of the load moved by the lifting device, the position of the lifting device, the position of the gripping means and/or the route of the lifting device in the operating area. The route of the lifting device may be determined e.g. as a position data of the route starting point and its destination and as one or more route points and their position data, as in FIGS. 2*a*, 2*b* and 2*c*.

TABLE 4

Example of operating modes of a bridge crane

| Bridge crane part | Operating mode parameter | Form and/or unit |
|---|---|---|
| Trolley | Position | Distance from bridge end (Y) |
| | Speed | E.g. m/s |
| | Direction | Direction 1 or 2 |
| | Speed limit | Percentage of maximum speed |
| | Driving instruction | E.g. speed and direction |
| | Traffic prohibition | On/Off |
| | ESD, estimated stopping distance | Meters, in direction of trolley and bridge movement |
| | ESP, estimated stopping position | As coordinates (X, Y) of operating environment |
| Bridge | Position | Coordinates (X) of operating environment, such as warehouse |
| | Speed | E.g. m/s |
| | Direction | Direction 1 or 2 |
| | Speed limit | Percentage of maximum speed |
| | Driving instruction | E.g. speed and direction |
| | Traffic prohibition | On/Off |
| | ESD, estimated stopping distance | Meters, in direction of trolley and bridge movement |
| | ESP, estimated stopping position | As coordinates (X, Y) of operating environment |
| Hook | Position | Trolley coordinates (Z) |
| | Speed | E.g. m/s |
| | Direction | Direction 1 or 2 (up/down) |
| | Speed limit | Percentage of maximum speed |
| | Driving instruction | E.g. speed and direction |
| | Traffic prohibition | On/Off |
| | Sway angle | E.g. degrees, in directions of bridge and trolley |
| Load | Dimensions | Trolley coordinates (X, Y, Z) |
| | Speed | Direction and speed (m/s) |
| | Loading space | On/Off |
| | Sway angle in movement directions of lifting device | E.g. degrees, in directions of bridge and trolley |

As disclosed in connection with the operating modes of the bridge crane in table 1, according to an embodiment the position data of a load and the gripping means are shown on separate coordinate axes and the position and speed of the lifting device on other coordinate axes, because some embodiments of the invention require that the observations are processed on different coordinate axes.

According to an embodiment, the directions of the lifting device parts may be presented as directions of the coordinate axes. Each axis thus determines two directions of movement, 1 and 2, for example forwards and backwards, as shown in table 4. In other words, the bridge, trolley and hook of a bridge crane may each be determined a movement direction in a 3D coordinate system by assigning each of the bridge, trolley and hook a respective axis (x, y, z) in the direction of which the direction of the part in question will be given.

The speed data may comprise load speed, lifting device speed and/or the speed of the gripping means.

The load data comprises data on whether there is a load on the lifting device. This may be a separate data item or it may be deduced on the basis of the outer dimensions and the weight data of the load. For example, when both the outer dimensions and the mass are substantially zero, there is no load on the lifting device and the loading data is "not loaded"/"off". In other cases the loading data may receive the value "loaded"/"on".

When the operating mode is "traffic prohibition" the lifting device cannot drive or move a load.

The driving instruction may comprise an instruction of use of the lifting device that the lifting device is to follow, e.g. an instruction on the speed to be used or a standard height of the load during use of the lifting device.

The speed limit may be a speed instruction set by the operator on the highest speed to be used on the lifting device.

When the lifting device is a bridge crane, the speed limit may determine the maximum speed of the bridge crane trolley and the bridge.

In the operating area of the lifting device, a restricted object 306, in whose area the operation of the lifting device is restricted in comparison with the operating area around the object, is positioned as being present. The object may be e.g. a human being, container, or a structure in the operating environment of the lifting device, such as a wall or a beam, or an area in the operating environment that may be identified by the positioning means. The operation of the lifting device in the object may be restricted. The restricted operation may comprise limiting the operating mode of the lifting device in comparison with its current operating mode.

The positioning 306 of the restricted object may comprise reception of position data from the positioning means. The position data may comprise the position of the restricted object in the operating area of the lifting device. The position may comprise a point or a plural number of points in a selected coordinate system. The selected coordinate system may consist of the coordinates of the operating area of the lifting device, in which case the received position data determines the position in the operating area. The selected coordinate system may also consist of the coordinates of the lifting device, in which case the received position data determines the position in relation to the lifting device. When the lifting device is a bridge crane, the origin of the coordinate axes of the positioning means may be set into the trolley. According to an embodiment, the received position data determines the lifting device in the operating area. The area may be determined as a geometric shape, such as a circle, rectangle, rectangular prism, ball or straight circular cylinder. The restricted object is preferably within this area, in which case when a distance to the restricted object is calculated, the restricted object is known to be at least at the calculated distance from the lifting device. Distance calculation preferably comprises determining distances in directions of movement of the lifting device, e.g. in directions x and y. In addition, the direction of movement of the lifting device is preferably taken into account in the distance calculation. When a plural number of coordinate points are received as position data of a restricted object, the coordinate points may determine the area of the restricted object. Determining an area on the basis of received position data is described below with reference to FIG. 5 and step 504.

Figure 7A:
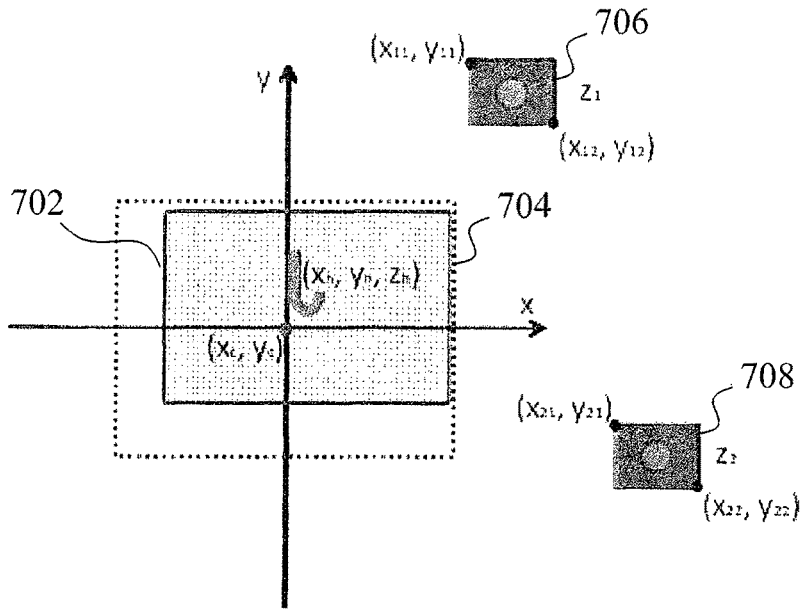
FIG. 7*a* shows positioning according to an embodiment of a load of the lifting device and restricted objects.
Figure 7B:
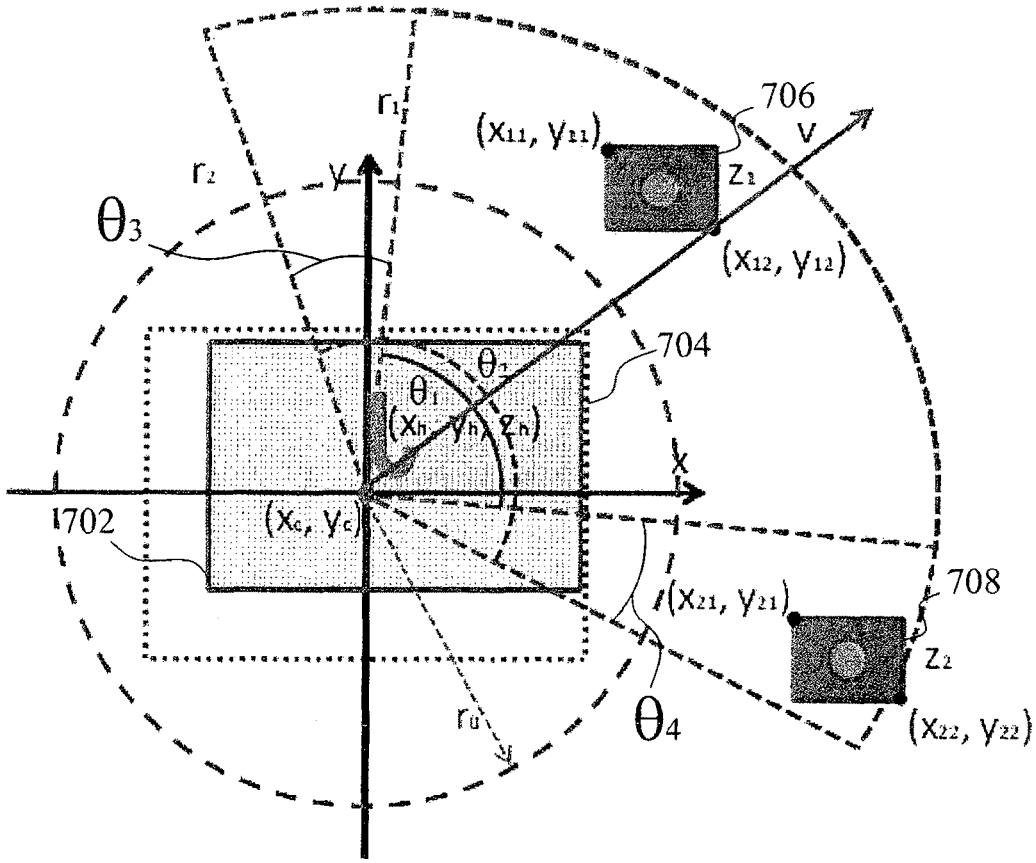
FIG. 7*b* shows positioning of a load of the lifting device and restricted objects in a sector opening in the direction of the load speed according to an embodiment.

The positioning of a restricted object is illustrated in FIGS. 7*a* and 7*b*. In FIGS. 7*a* and 7*b* the Cartesian coordinate system is used in the positioning, the coordinate axes being preferably set in accordance with the directions of movement of the lifting device. The lifting device may comprise a bridge crane, for example, such as the bridge crane shown in FIG. 8*a*. In that case the coordinate axes x and y in FIGS. 7*a* and 7*b* may be set in the directions of movement of the bridge and the trolley. The coordinate system is preferably a 3D coordinate system, in which case each direction of movement of the lifting device, such as a bridge crane, may be given a separate coordinate axis, the x-, y-, or z-axis. In FIGS. 7*a* and 7*b* the direction of the z-axis is perpendicularly into the Figure.

In FIGS. 7*a* and 7*b* each restricted object 706, 708 is positioned by receiving position data from the positioning means. Each restricted object 706, 708 is positioned by two coordinate points. The coordinate points determine an area for each restricted object. In the examples of FIGS. 7*a* and 7*b* the restricted object area is rectangular. The coordinate points received for each object may determine opposite corner points, for example, of the restricted object area, as in the examples of FIGS. 7*a* and 7*b*. In that case an area has been determined to the object 706 by corner points $(x_{11}, y_{11})$ and $(x_{12}, y_{12})$ and an area to object 708 by corner points $(x_{2i}, y_{21})$ and $(x_{22}, y_{22})$. In FIGS. 7*a* and 7*b* each object has been assigned z-axis values, $z_1$ and $z_2$, which together with the corner points x and y determine the 3D form of the detected objects. The value of the z-axis may be determined as a height of the object from the floor/ground, for example, so when a load height from the floor/ground $z_h$ exceeds object height $z_h>z_1$ or $z_h>z_2$, the load 702 could be driven above certain objects, such as containers or tables. According to an embodiment, when the object 706 or 708 is a human being, its height in the direction of the z-axis prevents the lifting device from being driven above it. Height may be given the highest possible value, for example, or a value corresponding to infinity, and thus $z_h<z_1$ or $z_h<z_2$. With further reference to FIG. 3, the operating mode of a positioned restricted object is determined in step 308. The operating mode of the restricted object determines the operating mode that the lifting device is to obey when moving or driving a load in the area of the restricted object.

Determining the operating mode may comprise determining the operating mode of the positioned 306 restricted object on the basis of the type of the restricted object. In that case the determining may comprise identification of the type of the restricted object. The restricted object may be stationary, for example, or moving. In that case a change in the position data of the restricted object may indicate the restricted object as a moving object. On the basis of a change in the position data, it is also possible to determine a speed for the restricted object and the speed may be used for defining the restricted object to be moving. On the basis of a change in the position data it is also possible to determine the direction of the movement of the restricted object.

According to an embodiment, the type of the restricted object is identified on the basis of the dimensions of the restricted object. The dimensions of the restricted object may be identified for example by image identification algorithms used for processing an image received from one or more cameras of the positioning means. When a radio frequency positioning system is used, the type of the restricted object may be identified from the received radio frequency signal, which contains an indication of the type of the restricted object. It is to be noted that the received radio frequency signal on the basis of which the restricted object is positioned, by triangulation of either the position data contained therein or a plurality of received radio frequency signals, may contain operating mode data of the lifting device or parts thereof. In that case the type of the restricted object may be determined directly on the basis of the operating mode applied within its area, without image identification or type indication in the radio frequency signal. For example, when the received operating mode includes a traffic prohibition, for the entire lifting device or a part of it, the restricted object may be determined as a protected object into the area of which no load or any part of the lifting device may be driven.

In an example where a height dimension of the restricted object prevents the lifting device from being driven within the restricted object area, i.e. above the object, the type of the restricted object may be determined as a human being. Suitable values for the dimension of the restricted object in the height direction are the maximum value of the coordinates or infinity, for example. According to yet another embodiment the type of the restricted object is identified on the basis of the information received from the lifting device operator. The lifting device operator supplies the type data of the restricted object through the user interface of the lifting device, for example. The operator may have determined the type data from the user interface in advance, in which case it suffices to detect and identify the restricted object. For example, the operator may enter a human being as his/her type and determine 2 in advance a circle of a 2-meter radius as his/her safety zone. The operator may carry a device positioned by radio positioning (or the device may be part of the lifting device controller), which the positioning device detects in the operating environment of the lifting device. When the device is identified in connection with positioning, the size of the safety area of the restricted object in question is known in advance and may be utilized for controlling the lifting device. Correspondingly, characteristics of areas and objects may be determined in advance on the basis of image identification, so when an object is identified, its type and other characteristics are known.

According to an embodiment, the restricted object is identified to be moving and thus the operating mode of the restricted object is determined to comprise a traffic prohibition. This means that driving of the lifting device or its parts, including the load to be transferred, in the area of the restricted object may be prevented. Since a moving restricted object may change its direction of movement, the lifting device and the distance to the restricted object may decrease even rapidly. A traffic prohibition concerning the area of a moving restricted object thus allows a safe distance to be maintained between the lifting device and the moving restricted object, and hence accidents may be avoided. Especially when the direction of speed of the moving object is towards the lifting device or the load it is moving, it is preferred to set a traffic prohibition as an operating mode of the restricted object as it allows adjustment of the lifting device operation to be started immediately so as to avoid a collision of the lifting device and/or the load moved by it with the moving restricted object.

As an example, an operating mode of a restricted object is determined 308 to comprise a speed limit. This allows the speed of the lifting device to be restricted in the positioned object, whereas there is no speed limit in the operating area around the positioned object or the speed limit is higher than in the positioned object. The positioned object may be determined as an area in the operating environment of the lifting device, in which case the restrictions apply to the area of the positioned object.

As an example, an operating mode of the restricted object is determined 308 to comprise a restriction relating to the load. The restriction may prohibit the bringing of load into the area, or the size of the load driven into the area is restricted in relation to the load dimensions and/or mass, for example. Correspondingly, the load may be subject to a smaller restriction in the area around the restricted object, where the load may be driven without restrictions and/or a bigger load size is allowed. Restrictions to be set on load dimensions may be determined in the selected coordinate system. The coordinate system to be used may be a three-dimensional Cartesian coordinate system, for example, in which case the load dimensions may be restricted with regard to width, height and/or depth. Restricting the load size enables to avoid too large loads from being driven in the area of the restricted object, and the operation of the lifting device may be adjusted according to a weight limit or a maximum load height, if any, applied in the restricted object. When a restriction to be obeyed in the restricted object relates to load dimensions, loads of different sizes with regard to their dimensions, such as containers, may be gathered in desired areas of the operating environment, such as a warehouse, of the lifting device. This allows the use of space in the operating environment, such as a hall in a warehouse, to be efficiently planned.

A difference between the current operating mode of the lifting device and the restricted operating mode to be applied in the object is determined 310. With reference to table 4 above, the difference may be a difference between any operating mode parameters. Hence the difference may be a difference between speeds, in which case the speed of the lifting device or a part thereof, such as the trolley, must be adjusted to a lower speed to be applied in the restricted object.

When an operating mode to be applied in the restricted object comprises e.g. a traffic prohibition, i.e. the operating made parameter for traffic prohibition has a value "on" with regard to the lifting device or a part thereof, whereas in its current operating mode the lifting device is not subject to a corresponding traffic prohition, i.e. the operating mode parameter for traffic prohintion has a value "off", there is a difference between the Operating modes and the lifting device is to be stopped so that the lifting device or a specific part thereof, which is subject to the traffic prohibition, is not driven into the area of the restricted object.

When the current operating mode of the lifting device with regard to loading, for example, is "on", i.e. the lifting device carries a load, and the operating mode of the restricted object with regard to a load is "off", there is a difference between the operating modes.

To determine the difference, the operating mode parameters, such as those in the above examples for traffic prohibition and loading, may be given values that may be numbers in the decimal system or in some other number system. This allows the difference between the operating modes of loading to be calculated as a difference between a binary number '1' corresponding to value "on" and a binary number '0' corresponding to value "off", for example. Correspondingly, binary number values may be given to traffic prohibition values "on" and "off" for calculating the difference.

On the basis of the difference, the distance travelled by the lifting device is determined 312 when the current operating mode of the lifting device is changed to the operating mode to be applied in the restricted object. The movement distance to be determined is calculated from the current operating mode of the lifting device and with the values of the current operating mode parameters of the lifting device. The movement distance obtained gives the maximum distance travelled by the lifting device or a part thereof during the time when movement into the restricted object area is stopped, the relative speed of the lifting device to the restricted object being then substantially zero.

In some cases the lifting device contains functions that determine "an estimated stopping distance (ESD)" for the lifting device, see table 4, and the distance may be directly used as a movement distance. In another case the movement distance of the lifting device may be determined by the following formula:

$$x_N = v_N^2/(2a_N) + f/d) \quad (1),$$

where $v_N$ is the lifting device speed, $a_N$ is deceleration and f(d) is an increase in the movement distance caused by the lifting device state d as the load is being decelerated. The increase in the movement distance f(d) is typically caused by an anti-sway function of the load. The anti-sway function is a control method of the lifting device for attenuating load swaying during suspension and transfer. Swaying is caused e.g. by movement of the lifting device and disturbances, such as wind. The anti-sway function is used to increase safety and the accuracy and speed of load handling. In this context the lifting device states d may comprise e.g. lifting device speed, hook sway angle and angular speed, load mass and rope length. If the lifting device is not provided with an anti-sway function, the term f(d) may be replaced by a constant determined lifting-device-specifically on the basis of the maximum speed, for example, or by a term depending on speed, deceleration, rope length, load mass or some of these.

With the increase in the movement distance excluded, the precise mathematical form of which may vary, as stated, the stopping time of the lifting device is obtained as follows:

$$t=v_N/a_N, \quad (2),$$

during which time the positioned object moves for a distance of $$x_K=v_K\cdot t+\tfrac{1}{2}\cdot a_K\cdot t^2=(2v_N\cdot v_K\cdot a_N+v_N^2\cdot a_K)/(2\cdot a_N^2), \quad (3)$$

where $x_K$ is the movement distance of the restricted object during the time taken by the stopping of the lifting device, and $v_K$ and $a_K$ are the speed and acceleration of the restricted object. The acceleration of the restricted object may often be assumed to be zero, if it cannot be determined accurately.

When a need to change the operating mode of the lifting device is estimated, the movement distance (1) of the lifting device is compared with the movement distance (3) of the object, taking into account the position of the restricted object in relation to the lifting device and the dimensions of the lifting device. Distances of movement are estimated in the directions of movement (x, y, also z, if required) of the lifting device. For example, if the lifting device moves at a speed of 1 m/s (the example assumes a movement in one direction only) and its deceleration is 0.5 m/s$^2$, the movement distance of the lifting device is 1 m and the lifting device stops in 2 seconds. If the speed of a detected restricted object is 1 m/s towards the lifting device (object visibility zero), the movement distance of the restricted object is 2 m (towards the lifting device). If the dimensions of the load are for example 2 m×2 m×1 m and the load is attached to the hook from the middle, the hook being directly below the origin of the coordinate axes of the lifting device, the leading edge of the load travels at a distance of 1 m from the lifting device. If the restricted object is at a horizontal distance of 4 m from the lifting device (in relation to the origin of the coordinate axes of the lifting device), it is noticed that a deceleration of the lifting device must be started in order to avoid collision. In other words, a need for changing an operating mode of the lifting device is detected on the basis of the movement distance. This is because at the start the load is 1 m from the origin of the lifting device and due to the movement distance of the lifting device, the outermost edge of the load stops at 2 m from the original origin. The detected object is first at a location of 4 m, and continues its movement towards the lifting device (2 m) during the deceleration thereof. The lifting device stops without the load hitting the object unless the object continues moving towards the load even after the lifting device has stopped.

The distance of the lifting device to the restricted object is determined 313. The distance between the lifting device and the restricted object may be calculated as the distance between the positions of the lifting device and the restricted object. The positions of the lifting device and the restricted object may be determined for example either by the coordinates of the operating area of the lifting device or by those of the lifting device. The coordinate system selected for use in the operating area may be the Cartesian coordinate system. The distance between the lifting device and the restricted object may be determined in each direction of the selected coordinate system; for example, when the Cartesian coordinate system is selected, the distance may be determined in directions x and y.

According to an embodiment, the distance between the lifting device and the restricted object is determined as a distance between the position of the restricted object area and that of the lifting device, the restricted object area being determined on the basis of the coordinates of opposite corner points in a rectangular area. This is illustrated in FIGS. 7*a* and 7*b* and by restricted objects 706 and 708. The lifting device position may thus be determined e.g. as a position of the lifting device trolley ($x_c$, $y_c$) or a hook position ($x_h$, $y_h$, $z_h$) or as a load position.

According to an embodiment, the distance between the lifting device and the restricted object is determined 313 between the lifting device load and the restricted object. The load and the restricted object may determine their own areas within the lifting device operating area, as shown in FIGS. 7*a* and 7*b*, in which the restricted objects have rectangular areas 706 and 708. Also the dimensions 702 of the load may be determined as a rectangular area. In lifting devices where the load is moved by lifting or lowering it on ropes, swaying of load may occur, and the swaying of the load may be taken into account by determining a sway area 704 for the load. The determining of the sway area may comprise positioning the load during a period of time, the highest dimension of the load in the direction of each coordinate axis being determined during the period. The selected time period may be 5 seconds, for example. This allows the sway area of the load to be determined and taken into account for calculating the distance between the load and the restricted object.

Figure 8A:
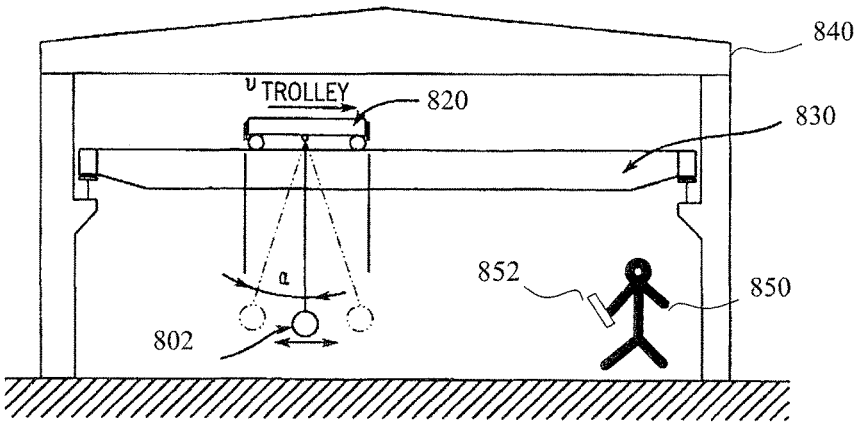
FIG. 8*a* illustrates a lifting device according to an embodiment in its operating area.
Figure 8B:
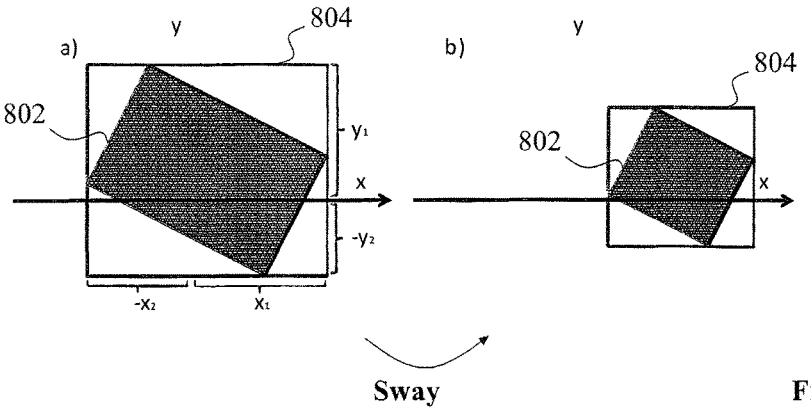
FIG. 8*b* shows positioning according to an embodiment of a load of a lifting device according to an embodiment.

FIG. 8*b* shows an example of the determining of the sway area 804 for use in connection with step 313 of the figure, for example. In FIG. 8*b* the load 802 has turned and sways from situation a) to situation b). In that case the dimensions of the load may be determined from the greatest dimension of the lifting device load in each direction of movement of the lifting device. In case a) of FIG. 8*b* the opposite corners in a rectangular area spanned by points ($-x_2$, $-y_2$) and ($x_1$, $y_1$) determine the sway area of the load in the coordinate system. In FIG. 7*a* the sway area of the load 702 is shown by an area 704 depicted by a broken line, and when the area is greater than the load, the load can be concluded to have swayed horizontally during the determining of the sway area. With a further reference to FIG. 3, the determining 313 of the distance between the restricted object and the lifting device may further comprise determining a distance between the restricted object and a sway area determined on the basis of the turning of the load and its swaying.

If 314 the distance of the lifting device to the restricted object corresponds to the determined movement distance, the lifting device can be stopped before the restricted object is reached. In that case it is safe to adjust the current operating mode of the lifting device to the operating mode 320 of the restricted object. If 314 the distance of the lifting device to the restricted object is smaller than the determined movement distance 312, the entry of the lifting device into the restricted object is to be expected. In practice this may mean a collision when the restricted object is a pillar, for example. It is also possible that no collision takes place if the restricted object moves away from the lifting device, for example, i.e. the distance between the lifting device and the restricted object increases. However, to minimize damages caused by the entry into the restricted object area, the stopping of the lifting device movement is preferably started if the distance of the lifting device to the restricted object is smaller than the predetermined movement distance. This allows damages caused by a possible collision to be minimized.

Adjustment 320 of the operating mode of the lifting device may comprise determining of a new route. Determining a new route allows changes in the direction of a moving restricted object to be anticipated in order to avoid a possible collision. The new route may be determined by changing the movement of the lifting device in the movement direction according to its current operating mode to a new direction of movement. The new direction of movement preferably deviates from the current direction of movement of the lifting device by 45 degrees, which means that the lifting device does not need to be stopped and the detected object may be bypassed with the crane continuously moving. An example of the determining of a new route is shown in FIG. 2*b*, in which a new route 214 is determined for the lifting device. In FIG. 2*b* the direction of movement of the lifting device load is changed to a new direction of movement, which is perpendicular to the direction of movement according to a previous, old route 212. In the example of FIG. 2*b* the old route 212 of the lifting device, i.e. the direction of movement substantially parallel with the walls 202, 204 is changed to a direction of movement perpendicular to the walls, which changes the direction of movement of the load by about 90 degrees. This stops the advancement towards the human being 220 and allows a collision of the load and the human being to be avoided. The new direction of movement may thus also be 90 degrees, in which case the advancement in the direction of the restricted object ends, or as much as 180 degrees, in which case the distance to the restricted object increases even. For changes to be made in the lifting device route, the movement of the lifting device may be stopped and a confirmation from the operator may be requested for the new route determined. The confirmation is obtained through the user interface used by the operator, such as a radio controller or a panel computer, for example.

According to an embodiment, the operating mode of the restricted object comprises a traffic prohibition, the adjustment 320 of the operating mode of the lifting device comprising stopping the movement of the lifting device. In other words, in that case the lifting device is not driven into the restricted object and a possible collision of the lifting device and the restricted object can be avoided.

According to an embodiment, the adjustment 320 of the operating mode of the lifting device comprises warning the lifting device operator through the interface of the lifting device by sound signals, lights and/or controller vibration, for example. The operator thus receives information on an approaching restricted object and adjustment of the lifting device operation, which allows his/her attention to be drawn to a possible dangerous situation.

According to an embodiment, the operating mode to be applied in the restricted object does not allow a load according to the current operating mode of the lifting device to be taken there at all, which means that the load carried by the lifting device must be detached if the aim is to drive in the area of the restricted object. The adjustment 320 of the operating mode of the lifting device may thus comprise unloading of the entire lifting device load or a partial unloading of the load. When the load is unloaded to correspond to a load in accordance with the operating mode to be applied in the restricted object, the load according to the current operating mode of the lifting device may, however, be taken into the area of the restricted object in several batches. The difference between the operating mode of the lifting device and that of the restricted object comprise a difference between operating mode parameters regarding loading or a difference in load size, such as a difference in dimensions or a difference in mass. Despite the restrictions on the operating mode applied in the restricted object, the lifting device load may thus be taken, when necessary, into the restricted object area in smaller loads, by unloading the lifting device load into two or more loads. In other words, the lifting device load is unloaded to form two or more loads that are within the limits determined by the operating mode parameters regarding loads to be applied in the restricted object, the loads being e.g. smaller than or equal to the dimensions and/or mass determined by the operating mode parameters.

The load carried by the lifting device may differ from the loads allowed in the restricted object area, for example, with regard to the disclosed operating mode parameters shown in table 4, for example when the load mass and/or dimensions are too big. In that case the lifting device is not only stopped but the load is lowered and the gripping means are detached from the load, the lifting device being then allowed to move into the area of the restricted object.

According to an embodiment, when the operating mode of the lifting device is adjusted 320, the movement of the lifting device or a part thereof, such as a trolley or hook, does not need to be stopped, as may be the case if the operating mode to be applied in the restricted object does not comprise a traffic probition. In that case the adjustment may comprise decreasing the lifting device speed to correspond to the speed limit in the restricted object. As shown in table 4, the speed of the lifting device may be determined for parts thereof, such as the hook or the trolley, and/or its load, for example.

According to an embodiment, the operating mode of the restricted object comprises a minimum height for the lifting device hook. In that case the adjustment 320 of the operating mode of the lifting device comprises raising of the hook to the minimum height. When the lifting device has been loaded by a container fastened to the hook, for example, the restriction on the minimum height does not concern the hook but the minimum height of the container bottom from the floor/ground. This enables to prevent, irrespective of container size and suspension straps, the container from being driven too low to the restricted object area.

According to an embodiment, the adjustment 320 of the operation of the lifting device comprises changing the mode of control of the lifting device on the basis of a change in the operating mode. When the operating mode of the lifting device changes to the operating mode of the restricted object or the area of the restricted object is entered, the control mode of the lifting device may be changed. According to an example, the previous control mode may be changed to radio control. According to another example, the control mode may be changed to a control shown in FIG. 6, in which the distance to the restricted object, such as the lifting device operator, is kept substantially constant during operation. With reference to the example in FIGS. 2*a*, 2*b* and 2*c* of the lifting device in its operating environment, the control mode of the lifting device that may be used is a control mode of FIG. 6 based on a constant distance when the lifting device is in the starting point area 206 or at the destination 208. When the lifting device is outside the starting point and the destination, radio control may be used as the control for moving the load 210 between the destination and the starting point. A change in the control mode may be informed to the lifting device operator through the user interface of the lifting device by sound and/or light signals, for example.

If 314 the distance of the lifting device to the restricted object is greater than the determined movement distance 312, the use of the lifting device may be continued without adjustment of the operating mode. In that case the method proceeds to step 304 and the method steps are repeated and a new decision 314 on the need to adjust 320 the operating mode of the lifting device may be taken.

The method ends 322 when the operating mode of the lifting device has been adjusted to the operating mode to be applied in the area of the restricted object positioned in the operating environment.

According to an embodiment, the movement distance 312 and the distance 313 of the lifting device are determined in each direction of the selected coordinate system, for example in directions x and y of the Cartesian coordinate system. The coordinate directions may be set to the directions of movement of the lifting device, for example. When a crane is being driven, it may have a speed in each coordinate direction, so, assuming that the direction of movement of the crane remains constant, the movement distance is to be evaluated separately in each direction in order to know whether there is a need to decelerate the movement in direction x or y, for example, or in both directions.

Figure 4:
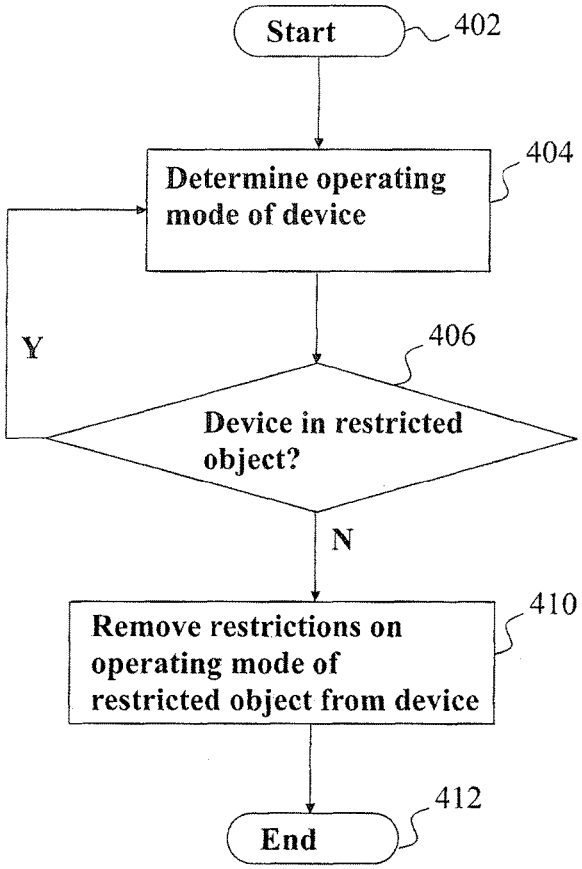
FIG. 4 shows a method according to an embodiment.

FIG. 4 shows a method according to an embodiment. In the method of FIG. 4 the operating mode of the lifting device is adjusted on the basis of the position of the lifting device in its operating environment. The method starts 402 when the lifting device has arrived at a restricted object area detected in its operating environment. The lifting device may arrive at the restricted object area in the manner disclosed in the method of FIG. 3, for example, when it is used for carrying a load in its operating area or for fetching a load to be carried.

The operating mode of the lifting device is determined 404. When the operating mode of the lifting device is determined, the lifting device is positioned. If the restricted object is moving, also the restricted object is positioned. The positioning of the lifting device and the restricted object may be carried out as disclosed with reference to steps 302 and 304 of FIG. 3.

When the lifting device is no longer within the area of the restricted object, the operation of the lifting device no longer needs to be adjusted to the operating mode applied in the restricted object. This may occur as a result of the movement of the object and/or the lifting device. With the lifting device outside the restricted object, the restrictions 410 on the operational mode to be applied in the restricted object are removed from the lifting device. The restrictions may be removed when the lifting device is outside the restricted object area and the direction of movement of the lifting device is away from the restricted object.

When the lifting device is within the area of the restricted object, the operating mode of the lifting device may be monitored by determining 404 changes in the operating mode.

The method ends 412 when the restrictions on the operating mode to be applied in the restricted object have been removed 410 from the lifting device.

Figure 5:
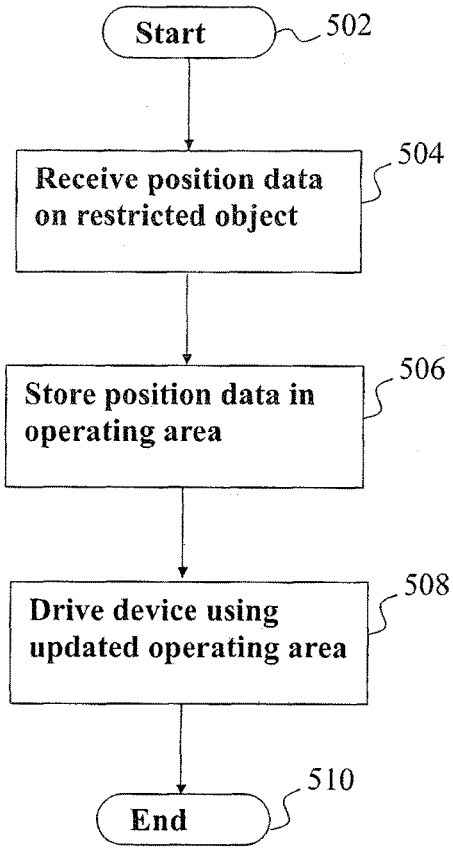
FIG. 5 shows a method according to an embodiment for the teaching of an operating area.

FIG. 5 shows a method according to an embodiment for teaching an operating area to a lifting device provided with a security assistant. The security assistant in the lifting device provides position data on objects in the operating environment of the lifting device. The objects may be restricted objects in which the operation of the lifting device is restricted. Objects in the operating environment of the lifting device, such as unloading and loading areas of cargo, are determined as positions in the operating environment. The positions may be determined in the selected coordinate system, where also the position of the lifting device is determined. The lifting device and/or the security assistant installed therein may thus form an operating area of the lifting device in which the positions of the different objects are stored. In addition to the positions of the objects, data on the operating mode the lifting device is to apply in each position may be stored in association with each position. In other words, the position may determine the operating area and the operating mode to be applied in the area. This type of operating area allows a lifting device route to be planned for carrying separate loads and/or an automated operation of the lifting device to be provided on predetermined routes. The method starts 502 when the lifting device and/or the security assistant installed in association with it contains an operating area that contains, in turn, data on objects within the operating area. The lifting device may have a predetermined route in the operating area. The lifting device route may be determined as shown in step 320 of FIG. 3, for example, where a restricted object that is too close is detected upon carrying a load. The route may also be determined as disclosed with reference to FIGS. 2*a*, 2*b* and 2*c*. With reference to FIGS. 2*a*, 2*b* and 2*c*, the lifting device route comprises a starting area 206, a destination area 208 and one or more locations 210 between the starting area and the destination area, through which the lifting device moves a load from the starting area to the destination area. The locations between the starting and the destination areas may be positions in the operating area of the lifting device determined by means of the selected coordinate system, for example. When the lifting device route has been determined, the lifting device may be driven on the determined route in its operating area. When the lifting device is being driven, it is moved in the operating area. The moving may comprise moving of the lifting device in a horizontal cross-sectional plane of the operating environment, such as a warehouse, as disclosed in FIGS. 2*a*, 2*b* and 2*c*. The moving of the lifting device may also comprise a vertical movement of the lifting device, when the gripping means of the lifting device are lowered or raised, for example.

It is to be noted that the method may also start without information on objects in the operating area, for example when the lifting device is taken in use in a new operating environment. In that case the method allows the lifting device to be taught a completely new operating environment and its objects.

Position data on the restricted object is received. The position data may be received from the security assistant. The position data may comprise the position of the restricted object in a selected coordinate system. The position data may be received as disclosed in step 306 of FIG. 3. The security assistant comprises the necessary positioning means for producing position data, as disclosed with reference to FIG. 1.

According to an embodiment, the position data is received 504 from a radio transmitter installed in the restricted object. The radio transmitter may be installed in the centre of the restricted object. In that case the restricted object may be positioned as an area whose centre point is in the position of the radio transmitter. The shape of the area may be a selected geometrical shape, for example, such as a rectangle, circle, rectangular prism or sphere.

According to an embodiment, a plural number of radio transmitters may be provided and they may be placed on opposite sides of the restricted object. In that case the restricted object may be positioned 504 as an area with a geometrical shape that is spanned between positions indicated by the radio transmitters. The geometrical shape may be a rectangle, for example, in which case the positions of the radio transmitters determine the opposite corners of the rectangle. The geometrical shape may also comprise more than two dimensions, such as a rectangular prism, in which case the positions of the radio transmitters determine a three-dimensional volume for the operating area of the lifting device, the restricted object being placed within the three-dimensional volume determined by the radio transmitters.

According to an embodiment, the position data is received through the user interface of the lifting device. In that case the operator determines by the user interface a shape and/or height of a security area, for example.

According to an embodiment, the position data is received 504 from a positioning pattern placed in the operating area of the lifting device, the pattern standing out from the operating environment when the security assistant carries out object positioning from the operating environment of the lifting device by means of one or more cameras and pattern recognition of picture signals obtained from the cameras. The positioning pattern in question may comprise alert colours, such as yellow and/or red, and geometrical shapes facilitating the positioning of the pattern. Suitable geometrical shapes are a circle, triangle or cross that stand out from the background. Resolution from the background provides a sufficient contrast for a device based on machine vision, for example.

The positioning pattern allows the area of the restricted object to be determined by positioning one or more positioning patterns in the same way as disclosed above with reference to one or more radio transmitters.

The received 504 position data is stored in the operating area 506 of the lifting device. The position data may be stored in the operating area as an area formed by means of radio transmitters and/or positioning patterns as disclosed above. In other words, it is possible to position a restricted object in the operating environment of a lifting device by using both one or more positioning patterns and one or more radio transmitters to determine an area in the restricted object.

According to an embodiment, the positioning of a restricted object and its storage in the operating area of the lifting device requires both the positioning pattern and the radio transmitter to be positioned. The restricted object may be marked with the positioning pattern. Preferably the positioning pattern is on a projection of the object, such as a corner, e.g. on a container corner, the location of the positioning pattern thus determining dimensions of the restricted object. The restricted object is stored 504 in the operating area of the lifting device only after a positioning pattern and a radio transmitter have been determined to form a pair. The operator of the lifting device may determine this by means of the interface of the lifting device, for example, in which one or more positioning patterns of the operating area are shown. In that case the restricted object is positioned by selecting from the operating area, through the interface of the lifting device, a positioning pattern that is to be linked as a pair with the radio transmitter. Next, the radio transmitter is placed to a desired location in the operating area. Consequently, on the basis of the positioning pattern and the radio transmitter positions made into a pair, a restricted object area may be determined, as disclosed above, for the positioning pattern and radio transmitters. Using a positioning pattern together with a radio transmitter for positioning restricted objects allows the restricted objects to be positioned as areas immediately when the radio transmitter is positioned, even if the operator had only one radio transmitter in use.

When a restricted object is being positioned 504 by radio transmitters or positioning patterns, one or more radio transmitters or positioning patterns may be used. It is also possible to use one radio transmitter or positioning pattern to implement the functionality of the more than one radio transmitter or positioning pattern disclosed above. In that case reception of positioning data from a restricted object comprises setting one radio transmitter or positioning pattern in a plural number of locations in the operating area, in which case each positioned location determines an area in the restricted object, for example by spanning a geometrical area, as disclosed above with reference to the plural number of radio transmitters and positioning patterns. When a desired number of locations has been positioned, they may be used for determining an area of a restricted object and the restricted object may be stored in the operating area 506 of the lifting device.

With the restricted object area determined; the lifting device may be driven 508. Since the operating area of the lifting device was updated with data 506 of the restricted object, the new restricted object must be taken into account when the lifting device is driven. The lifting device may be driven following the steps 308 to 322 of FIG. 3 and/or the method of FIG. 4, for example.

According to an embodiment, the lifting device is driven 508 and the operating mode to be applied in a new restricted object is determined. The determining may be carried out as in step 308. Next, the operation of the lifting device is adjusted to the operating environment, which comprises the new restricted object. The adjustment may comprise determining a new route for the lifting device, as disclosed in step 320 of FIG. 3. The adjustment of the lifting device route may be made immediately when the new object has been stored in the operating environment as disclosed in step 320 of FIG. 3, or when the distance to the restricted object is shorter than the movement distance, as in step 320 of FIG. 3. This allows the old route of the lifting device that existed at the beginning 502 of the method to be updated or an entirely new route to be formed for the lifting device. The method ends when the operating area of the lifting device has been updated by the position data 510 of the restricted object.

Figure 6:
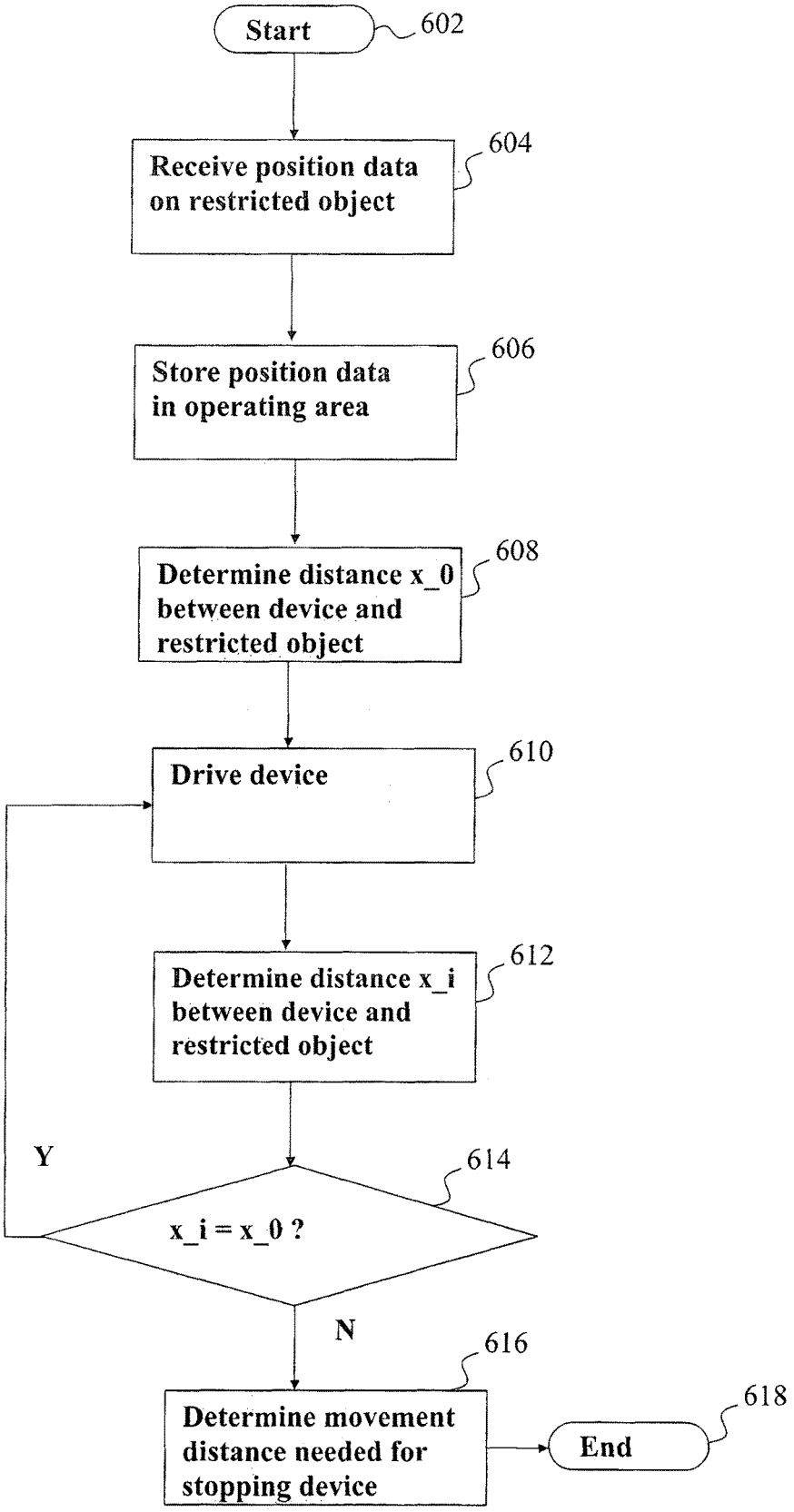
FIG. 6 shows a method according to an embodiment for driving the lifting device.

FIG. 6 shows a method according to an embodiment for driving the lifting device. In the method the driving of the lifting device is controlled by a moving restricted object. The moving restricted object may be the lifting device operator, for example. The lifting device is controlled on the basis of the distance between the restricted object and the lifting device, the distance being kept substantially constant. The restricted object to which the distance of the lifting device is kept substantially constant may be selected from the restricted objects stored in the operating area of the lifting device. The selection may be made by the lifting device operator, for example, who makes the selection through the lifting device user interface. Hence the position of the restricted object in the operating area of the lifting device is known and a separate positioning of the restricted object is not needed. The method may start 602 also without data on the operating environment or restricted objects stored in the lifting device.

Position data on a restricted object is received 604. This allows the restricted object to be positioned in relation to the lifting device and the lifting device to be controlled in relation to the restricted object. The position data may be received as disclosed above with reference to step 504 of FIG. 5 and/or step 306 of FIG. 3.

The received position data is stored 606 in the operating area of the lifting device. The storage may be carried out as disclosed with reference to step 506 of FIG. 5, for example. Also the operating mode of the lifting device to be applied in the restricted object area may be stored in connection with the position data. Possible operating modes and operating mode parameters have been given above with reference to FIG. 3, for example.

A distance $x_0$ between the lifting device and the restricted object is determined 608. The distance may be determined as disclosed with reference to step 313 of FIG. 3. When the distance is being determined, the lifting device is preferably stationary, as the distance can thus be determined as precisely as possible without inaccuracies and risks, if any, caused by load swaying to the restricted object which may be the lifting device operator. The determined distance may comprise a distance required to the lifting device on the basis of safety regulations, for example.

The lifting device is driven in step 610. The driving of the lifting device may comprise moving the lifting device or a part thereof. When a bridge crane is being driven, the trolley and/or hook of the bridge crane may be moved. When the lifting device is being driven, also the load attached to the lifting device may move. When the lifting device is being driven, operation of the lifting device, such as its speed or direction is adjusted so that the distance $x_0$ to the restricted object remains substantially the same.

A distance $x_i$ between the lifting device and the restricted object is determined, when the lifting device has been driven 610. The distance may be determined as disclosed with reference to step 313 of FIG. 3.

If $x_0$ is substantially equal to $x_i$, the driving of the device is continued 610. Otherwise 614, a movement distance 616 required for stopping the lifting device is determined. The method ends 618, when the lifting device is no longer driven on the determined distance $x_0$. The operation of the lifting device may then follow steps 314 to 322 of FIG. 3, for example, where the operation is based on the length of the movement distance required for stopping the lifting device in comparison with the distance between the lifting device and the restricted object.

According to an embodiment, the distance $x_1$ may deviate 614 from $x_0$ by 5%, for example, which means that minor changes in the distance between the lifting device and the restricted object are allowed as the lifting device is driven, and the driving may be continued 610. This allows inaccuracies of measurement to be taken into account and enables the lifting device to be implemented in a simple manner to be driven on the basis of the distance of a moving restricted object. Any impairments of safety possibly caused by the allowed deviation of 5% may be compensated for by correspondingly increasing the distance $x_0$ determined in step 608.

For example, a deviation of 5% may be allowed in the distance determined in step 608 $x_0$ by determining $x_{0_compensated}=x_0/0.95$, $x_{0_compensated}$ being determined so that a change of 5% in it is at least equal to $x_0$. The distance $x_i$ is thus compared to $x_{0_compensated}$ in step 614, and a decrease of 5% in the distance in comparison with $x_{0_compensated}$ is still greater than $x_0$. The distance determined in step 608 can thus be maintained, with both inaccuracies and requirements set by safety regulations, if any, taken into account.

According to an embodiment, distances between the lifting device and the restricted object are determined in the method of FIG. 6 in each direction of the selected coordinate system, the distance being thus obtained in steps 608 and 612 disclosed above in each direction, e.g. directions x and y. The coordinate axes may be set in the directions of movement of the lifting device, for example. When the lifting device is thus driven 610 with distances in each direction kept substantially constant in relation to the distances determined in step 608, the lifting device follows the restricted object, staying in the same direction. When the restricted object is the operator driving the lifting device, the operator always knows in which direction the lifting device is. Since not only the distance but also the direction remains substantially the same, the operation of the lifting device is easier to follow for the operator, which also increases safety.

FIG. 8*a* illustrates a lifting device according to an embodiment within its operating area. The lifting device of FIG. 8*a* is a bridge crane mounted in a warehouse 840. The bridge crane comprises a bridge 830 extending between the walls of the warehouse. It is to be noted that the bridge may be arranged between the outer walls, inner walls or an outer and an inner wall of the warehouse. The bridge crane further comprises a trolley 820 movable on the bridge between the walls. The bridge itself may also be movable parallel with the walls on a track, for example. In that case the directions of movement of the bridge and the trolley are typically perpendicular to one another. A load 802 is fastened to the bridge crane by gripping means, such as a hook. The hook and the load possibly attached to it are suspended by one or more ropes. The raising and lowering of loads or the hook alone by means of ropes involve a risk of swaying of the load or the hook. This means that a sway angle a is formed between the lifting direction and the rope. The swaying causes danger to personnel, structures and machines nearby.

The bridge crane may operate fully automatically in its operating environment, in which case no staff, i.e. operator, is needed when it is used for carrying loads. FIG. 8*a* shows a situation in which there is personnel, e.g. the operator 850, in the vicinity of the crane bridge. The operator may have a controller 852 for controlling the operation of the bridge crane. The controller may connect to the bridge crane by a wire or wirelessly, as in the case of FIG. 8*a*. Wireless operation allows the operator to keep a sufficient distance to the load also in case the load sways, as illustrated by a swaying load 802.

According to an embodiment, the controller 852 comprises a display. The display may be in the radio controller or the entire controller may be implemented by a panel computer 852, for example. In that case the user interface of the bridge crane may be shown to the operator 850 on the panel computer display.

FIG. 8*b* shows a positioning according to an embodiment of a lifting device load. In the figure the load 802 is positioned in a coordinate system that is centred to the lifting device trolley. In the example of FIG. 8*b* the coordinate axes are set in the directions of movement of the lifting device. When the lifting device is a bridge crane, as in FIG. 8*a*, the coordinate axes may be set in the directions of movement of the bridge and the trolley. The coordinates a) in FIG. 8*b* show the turning of the load in relation to the directions of movement. In that case the dimensions of the load may be determined from the greatest dimension of the lifting device load in each direction of movement of the lifting device. The coordinates a) thus produce the dimensions of the load in the form of a rectangle 804, spanned by opposite corner points (−x2, −y2) and (x1, y1).

The coordinates b) show that the load 802 is swaying. The sway angle may be a, for example, as in FIG. 8*a*. The swaying significantly change the position of the load. In the example of FIG. 8*b* the swaying load has moved entirely to the positive side of the x-coordinates. In that case the edge farthest away from the origin in the rectangle determined by the load dimensions in the directions of movement of the lifting device has thus moved to value x3 on the coordinate axis x, the value being at least |x1|+|x2|. It is to be noted that although the examples of FIG. 8*b* only show swaying in the direction of the x-axis, the position of the load may change, depending on the direction of the swaying, also in the direction of the y-axis or in the direction of both y- and x-axis. Swaying of the load is thus important to take into account for safe use of the lifting device.

As disclosed above, FIG. 7*a* shows a positioning according to an embodiment of a load of the lifting device and the restricted objects. In addition to the positioning, FIGS. 7*a* and 7*b* show a sway area 704 of the load 702. The sway area is used for determining load dimensions when a load distance to a restricted object is being determined in the above embodiments.

FIG. 7*b* shows positioning according to an embodiment of the lifting device load and the restricted objects in a sector 8 opening in the direction of the load speed. According to the embodiment, restricted objects are positioned in front of the lifting device in the direction in which the lifting device is moving. In other words, the sector in which the restricted directions are positioned is preferably 135 degrees and opens to the direction of the lifting device movement, shown by arrow v in the example of FIG. 7*b*. When the angle of observation of the restricted objects is limited so that restricted objects located behind in relation to the direction of movement of the lifting device are not positioned, the requirements set on the computation performance required of the lifting device and/or the security assistant installed therein may be reduced. According to an embodiment in which the security assistant sends information on positioned objects to the lifting device, such as a PLC-controlled lifting device, the positioning on a limited sector reduces the need for data transfer between the lifting device and the security assistant.

In the example of FIG. 7*b* the lifting device carries a load at speed v to the direction, shown by an arrow, where the object 706 is. When an angle is used for positioning restricted objects, both objects 706 and 708 are detected. When angle $\theta_2$ is decreased and angle $\theta_1$ is used, object 708 is no longer detected. This enables to further limit the number of restricted objects to be positioned. Restricted objects are preferably detected using a sector of over 40 degrees.

According to an embodiment, when the lifting device is stationary, restricted objects are positioned in every direction around the lifting device. A distance $r_0$ to be positioned may be selected as a radius from the origin of the coordinate axes, the origin being fixed in the case of a bridge crane, for example, to a trolley thereof. This allows the starting of the crane in any direction to be prepared for. When the lifting device has started moving, restricted objects are positioned in sector θ that opens in the direction of the speed that is in the direction of the load and at distance $r_1>r_0$, as disclosed above.

According to an embodiment, direction v of the lifting device speed changes, and the changed direction of the lifting device speed determines a new sector $\theta_n$, in which the movement distance of the lifting device is determined. The change in the direction of the lifting device speed may be due to the control by the operator driving the lifting device, for example. The determining of the movement distance may thus be adjusted to changes in the direction, which allows the movement distance to be determined in a direction that is the most essential for security.

According to an embodiment, restricted objects are positioned on a plural number of sectors $\theta_1, \theta_2, \ldots, \theta_n$. FIG. 7*b* shows an example of the plural number of sectors on which restricted objects are positioned. The sectors may comprise a primary sector $\theta_1$, on which restricted objects are positioned, and one or more secondary sectors $\theta_3$, $\theta_4$. The secondary sectors and the primary sector then determine a total sector $\theta_2=\theta_1+\theta_3+\theta_4$. The primary sector $\theta_1$ opens in the direction of the load speed v and the secondary sectors $\theta_3$, $\theta_4$ on the peripheries of the primary sector.

The restricted objects are positioned with greater precision on the primary sector $\theta_1$ than on the secondary sectors $\theta_3+\theta_4$. Positioning with greater precision requires more resources of the equipment used, for example with regard to memory capacity and/or processing power. When a plural number of sectors is used for positioning restricted objects, the resources required by the positioning may be reduced by using a high positioning precision on the primary sector only and a lower positioning precision on the secondary sectors. On the other hand, the determining of the primary and secondary sectors allows for a greater total sector $\theta_2$ to be positioned, in comparison with a single primary sector $\theta_1$ positioned with equal resources. When a plural number of sectors is used in the positioning as disclosed above, the precision of positioning on each sector has a corresponding effect on the precision of the determining of the movement distance. A further advantage of the use of a plural number of sectors is that it is known in advance whether there are objects in particular area, for example in connection with turning, and hence the turning may be restricted.

The time sequence of the steps and functions described in FIGS. 3, 4, 5, and 6 is not absolute and some steps and/or functions may be performed simultaneously or in a different order than described. Other functions may also be performed between the described steps and/or functions or they may be included in the described steps and/or functions. Some steps and/or functions may also be left out or they may be replaced with a corresponding step and/or function. The methods of FIGS. 3, 4, 5 and 6 may be chained, the disclosed methods being then repeated at regular or varying time intervals. The functionality of the security assistant described in the embodiments may be implemented in one or more physical or logical units.

The present invention is applicable to any load handling device, lifting device, crane, bridge crane, gantry crane, tower crane or harbour crane, such as a container crane, container straddle carrier, rubber tyre gantry crane or a gantry crane travelling on rails, or a dockside gantry crane, or to any combination of different devices for positioning an operating environment of the device.

In the embodiments disclosed above, the load may comprise a separate load, such as a container, to which the lifting device attaches for moving the load from a starting point to a destination. It is to be noted that, instead of a separate load, the load in the disclosed embodiments may also be formed by a functional part of the lifting device, the functional part allowing the lifting device to attach to the separate load for moving it. Examples of such a load comprise gripping means, such as a hook, rope or boom. In other words, the advantages of the above embodiments may be gained both on an unloaded and a loaded lifting device.

According to an embodiment, the operating modes of a restricted object may also be assigned through a factory computer, for example with a storage management software executed by it, in which case there is a data transfer connection set up between the control system of the lifting device and the factory computer. Data transfer between the systems may be two-directional. In other words, the storage management software may warn in advance the control system of the lifting device of articles piled one on top of the other. The lifting device, in turn, may check the matter with the positioning means when passing by and determine the position and height of the pile. Correspondingly, the lifting device may inform the storage management system of restricted objects it has detected and the storage management software may check them in its storage record. Restricted objects detected by the lifting device may be new restricted objects in the operating environment of the lifting device, or information on the detected restricted objects may already be stored in the storage management software.

Devices, such as load handling devices, lifting devices, cranes, bridge crane, gantry crane, tower crane or harbour crane, such as a container crane, container straddle carrier, rubber tyre gantry crane or a gantry crane travelling on rails or a dockside gantry crane, which implement the functionality of the device according to the above-disclosed embodiments, comprise not only prior art means but also means for determining the current operating mode of the lifting device as the lifting device is moving a load within the operating area; for positioning in the operating area an object in whose area the operation of the lifting device is restricted in comparison with the surrounding operating area; for determining a difference between the current operating mode of the lifting device and a restricted operating mode to be applied in the object; and means for determining on the basis of the difference a movement distance travelled by the lifting device when the current operating mode of the lifting device is changed to the operating mode to be applied in the restricted object. In addition, they may comprise means for starting the changing of the current operating mode of the lifting device to the restricted operating mode to be applied in the object when the distance of the load being moved by the lifting device from the restricted object is shorter than the determined movement distance. More specifically, they may comprise means for implementing the functionality of the device described in any one of the above embodiments, and they may comprise separate means for each separate function, or the means may be arranged to perform two or more functions. Prior art devices comprise processors and memory that may be utilized for implementing the one or more functionalities of the embodiments described above. For instance, the security assistant may comprise an application program or a module or a unit capable of an arithmetic function, or a program (including an added or updated software routine) that may be executed by a processor or a combination of processors, for example. Software, which may also be called software products including program routines, applets and macros, may be stored on any data storage medium readable by the device, and they contain program instructions for executing specific tasks. All changes and arrangements that are needed to implement the functionality of the present embodiment may be executed by routines that may be implemented either as added or updated software routines, application-specific circuits (ASIC) and/or programmable circuits. In addition, software routines may be downloaded into a device according to the described embodiment. The device, such as a security assistant, may be implemented by a computer or as a microprocessor, such as a one-chip computer element, that contains at least memory to provide a storage area for use in arithmetic operations and a processor for performing arithmetic operations. An example of a processor is a central processing unit (CPU). The memory may be detachably attached to the device or non-volatile.

It will be apparent to a person skilled in the art that as technology advances, the basic idea of the invention may be implemented in many different ways. The invention and its embodiments are thus not restricted to the examples described above but may vary within the scope of the claims.

The invention claimed is:

1. A method, comprising the steps of:

determining, by a processor, a current operating mode of a lifting device as the lifting device moves a load in an operating area;

positioning in the operating area, by a device connected to the lifting device, an object in an area, where the operation of the lifting device is restricted in comparison with the operating area around the object;

determining, by the processor, a difference between the current operating mode of the lifting device and a restricted operating mode to be applied in the restricted area including the object;

determining, by the processor on the basis of the difference a movement distance travelled by the lifting device when the current operating mode of the lifting device is changed to the operating mode to be applied in the restricted area including the object.

2. The method as claimed in claim 1, further comprising the step of:

beginning the changing of the current operating mode of the lifting device to the restricted operating mode to be applied in the object when the distance of the load moved by the lifting device from the restricted object is shorter than the predetermined movement distance.

3. The method as claimed in claim 1, comprising the step of:

removing from the lifting device the restrictions on the operating mode to be applied in the restricted object when the lifting device is outside the restricted object.

4. The method as claimed in claim 1, wherein the changing of the operation of the lifting device comprises one or more of the following: determining a new route, stopping the lifting device, raising a load, lowering a load, increasing speed, decreasing speed.

5. The method as claimed in claim 1, wherein when the operation of the lifting device is changed, the operator of the lifting device is warned through a user interface of the lifting device by one or more of the following: a sound signal, light, and a controller vibration.

6. The method as claimed in claim 1, wherein the operating area of the lifting device comprises restricted objects, each one of which has an area and an operating mode to be applied in the area, said method further comprising the steps of:

determining on the basis of the restricted objects a route for the lifting device in the operating area, the route comprising a starting area, a destination area and one or more locations between the starting area and the destination area, through which the lifting device moves the load from the starting area to the destination area;

driving the lifting device on the predetermined route;

receiving during the driving of the lifting device information on at least one new restricted object;

storing the new restricted object to the operating area;

determining an operating mode to be applied in the new restricted object; and updating the lifting device route on the basis of the operating mode of the new restricted object stored in the operating area.

7. The method as claimed in claim 1, further comprising the steps of:

determining a first distance between the lifting device and a restricted object, when the load of the lifting device is stationary;

determining a second distance between the lifting device and the restricted object when the lifting device is moving the load; and determining a movement distance required for stopping the lifting device that is being driven, when the first distance and the second distance differ from one another.

8. The method as claimed in claim 7, wherein the difference between the distances is smaller than or equal to 5%.

9. The method according to claim 1, wherein the movement distance $x_N$ of the lifting device to a restricted object is determined according to the following formula:

$$x_N=v_N^2/(2a_N)+f(d),$$

where $v_N$ is lifting device speed, $a_N$ is deceleration and f(d) is an increase in the movement distance caused by the lifting device state d as the load is decelerated.

10. The method as claimed in claim 1, wherein the movement distance of the lifting device is determined on a sector θ opening in the direction of speed of the lifting device, the sector being 180 degrees or smaller.

11. The method as claimed in claim 1, wherein the movement distance of the lifting device is determined on the basis of a distance determined between the lifting device and a restricted object on each axis of a selected coordinate system.

12. The method as claimed in claim 1, wherein the movement distance of the lifting device is determined on the sector θ opening in the direction of speed of the lifting device, a change in the direction of speed of the lifting device determining a new sector $\theta_n$ in the direction of speed of the changed lifting device for determining the movement distance of the lifting device.

13. The method as claimed in claim 1, wherein the movement distance of the lifting device is determined in a sector $\theta_2$ opening in the direction of speed of the lifting device, the sector comprising a primary sector $\theta_1$ and at least one secondary sector $\theta_3$, $\theta_4$, the positioning of the restricted object to be carried out in the primary sector being more precise than positioning carried out in a secondary sector.

14. The method as claimed in claim 1, wherein the distance of a load moved by the lifting device from a restricted object is calculated as a distance between the greatest dimension of the lifting device load in each direction of movement of the lifting device and the greatest dimension of the restricted object in each direction of movement of the lifting device.

15. The method as claimed in claim 1, wherein an operating mode comprises one or more of the following: position data, speed data, traffic prohibition, driving instruction, speed limit, outer dimensions of the load, load sway area, and load weight.

16. The method according to claim 1, wherein a plural number of restricted objects is determined in an operating area by positioning one or more radio transmitters placed in the operating area, each restricted object being determined by:

placing said one or more radio transmitters in the operating area;

positioning the one or more placed radio transmitters; and determining a restricted object in a position determined by the one or more radio transmitters placed in the operating area.

17. The method as claimed in claim 1, wherein data on an operating mode to be applied in a restricted object is received, the received operating mode data is stored in the operating area and a lifting device route is updated on the basis of the operating mode data of the restricted objects stored in the operating area.

18. The method as claimed in claim 1, wherein the lifting device comprises a lifting mechanism configured to move a load and a controller, the operator using the controller to control the lifting mechanism, the controller being connected to the lifting mechanism by a wireless data transfer connection and the operator being determined as a restricted object within the operating area of the lifting device.

19. A device comprising:

a positioning unit for observing an operating environment of a lifting device;

a calculating unit for calculating positions and speeds on the basis of observations received from the positioning unit; and an interface to a lifting device, said interface being connected to the lifting device to cause:

determining a current operating mode of a lifting device as the lifting device moves a load in an operating area;

positioning in the operating area an object in an area, where the operation of the lifting device is restricted in comparison with the operating area around the object;

determining a difference between the current operating mode of the lifting device and a restricted operating mode to be applied in the restricted area including the object; and determining on the basis of the difference a movement distance travelled by the lifting device when the current operating mode of the lifting device is changed to the operating mode to be applied in the restricted area including the object.

20. The device as claimed in claim 19, further comprising a gripping device configured to grip a load, the load being moved by one or more ropes fastened to the gripping device.

21. The device as claimed in claim 19, further comprising a load handling or lifting device, crane, bridge crane, gantry crane, tower crane or harbour crane, a container crane, container straddle carrier, rubber tyre gantry crane or gantry crane travelling on rails, or dockside gantry crane.

22. A method for updating a lifting device, the lifting device comprising a lifting mechanism configured to lift a load and a controller controlling the lifting mechanism and a communication path connecting the lifting mechanism and the controller, said method comprising the steps of:

connecting the device as claimed in claim 19 to the communication path.

23. A computer program embodied on a non-transitory computer—readable storage medium, the computer program comprising program instructions to execute, when executed in a processor, a method comprising the steps of:

determining a current operating mode of a lifting device as the lifting device moves a load in an operating area;

positioning in the operating area an object in an area, where the operation of the lifting device is restricted in comparison with the operating area around the object;

determining a difference between the current operating mode of the lifting device and a restricted operating mode to be applied in the restricted area including the object; and determining on the basis of the difference a movement distance travelled by the lifting device when the current operating mode of the lifting device is changed to the operating mode to be applied in the restricted area including the object.

24. The method according to claim 1, further comprising the steps of:

estimating a need to change the operating mode from the current operating mode to the restricted operating mode on the basis of comparing the movement distance of the lifting device with the movement distance of the object, taking into account the position of the restricted object in relation to the lifting device and the dimensions of the lifting device; and adjusting the operating mode of the lifting device based on the step of estimating.

* * * * *